US011535949B2

(12) United States Patent
Seki et al.

(10) Patent No.: US 11,535,949 B2
(45) Date of Patent: Dec. 27, 2022

(54) SUBSTRATE HOLDER AND PLATING APPARATUS

(71) Applicant: EBARA CORPORATION, Tokyo (JP)

(72) Inventors: Masaya Seki, Tokyo (JP); Hideki Takayanagi, Tokyo (JP); Kiyoshi Suzuki, Tokyo (JP); Masayuki Satake, Tokyo (JP); Jumpei Fujikata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/451,387

(22) Filed: Jun. 25, 2019

(65) Prior Publication Data

US 2019/0390359 A1 Dec. 26, 2019

(30) Foreign Application Priority Data

Jun. 25, 2018 (JP) ..... JP2018-119875

(51) Int. Cl.
*C25D 17/08* (2006.01)
*C25D 17/00* (2006.01)
*C25D 17/06* (2006.01)

(52) U.S. Cl.
CPC ..... *C25D 17/08* (2013.01); *C25D 17/001* (2013.01); *C25D 17/06* (2013.01)

(58) Field of Classification Search
CPC ..... H01L 21/68742; H01L 21/687; H01L 21/68764; H01L 21/6838; H01L 21/68721; C25D 17/001; C25D 17/06; C25D 17/08
See application file for complete search history.

(56) References Cited

U.S. PATENT DOCUMENTS 7,211,170 B2 * 5/2007 Antolik ..... H01L 21/68721 118/500
8,646,767 B2 * 2/2014 Kumnig ..... H01L 21/68728 269/903
9,418,883 B2 * 8/2016 Gleissner ..... H01L 21/68728
10,407,793 B2 * 9/2019 Fendel ..... C25D 17/004
10,573,541 B2 * 2/2020 Stone ..... H01L 21/67115
2012/0305404 A1 * 12/2012 Keigler ..... C25D 17/001 205/96
2013/0134035 A1 * 5/2013 Harris ..... C25D 17/008 204/242

(Continued)

FOREIGN PATENT DOCUMENTS

JP 2013-155405 A 8/2013
JP 2018-003085 A 1/2018
JP 2018-503745 A 2/2018

*Primary Examiner* — Alexander W Keeling
*Assistant Examiner* — Mofoluwaso S Jebutu
(74) *Attorney, Agent, or Firm* — Baker Hostetler LLP

(57) ABSTRACT

There is provided the substrate holder for holding a substrate comprising a first holding member, a second holding member, a sealing member, a pin, a ring, and a moving mechanism. The sealing member forms a sealed space inside the substrate holder. The pin is fixed to one of the first holding member and the second holding member. The ring is disposed on another of the first holding member and the second holding member. The ring engages with the pin. The moving mechanism circumferentially moves the ring. The pin and the ring are engaged with one another to fix the first holding member and the second holding member to one another. The pin and the ring are disposed inside the sealed space.

18 Claims, 19 Drawing Sheets

(56) References Cited

U.S. PATENT DOCUMENTS

| | | | | |
|---|---|---|---|---|
| 2013/0192983 | A1 | 8/2013 | Fujikata | |
| 2013/0333616 | A1 * | 12/2013 | Klindworth ..... | H01J 37/32743 118/719 |
| 2019/0203373 | A1 | 7/2019 | Fujikata | |

* cited by examiner

SUBSTRATE HOLDER AND PLATING APPARATUS

CROSS-REFERENCE TO RELATED APPLICATION

This application is based upon and claims benefit of priority from Japanese Patent Application No. 2018-119875 filed on Jun. 25, 2019, the entire contents of which are incorporated herein by reference.

TECHNICAL FIELD

The present invention relates to a substrate holder and a plating apparatus.

BACKGROUND ART

Conventionally, wiring has been formed on fine grooves for wiring, holes, or resist openings provided on surfaces of, for example, semiconductor wafers, and bumps (protruding electrodes) electrically connected to electrodes or similar components of packages have been formed on the surfaces of, for example, the semiconductor wafers. As such method for forming these wiring and bumps, a method such as an electrolytic plating method, a deposition method, a printing method, and a ball bump method has been known. In accordance with an increase in the number of I/Os of a semiconductor chip and decrease in pitch, the electrolytic plating method that allows miniaturization and provides comparatively stable performance has been often used.

To plate a substrate by the electrolytic plating method, a substrate holder holding the substrate such as a semiconductor wafer is immersed in plating solution and a voltage is applied to an anode and the substrate. When the plating to the substrate ends, the substrate holder is removed from the plating solution and the substrate and the substrate holder are cleaned. There has been known a substrate holder in which a substrate is sandwiched between a first holding member and a second holding member to be held as a conventional substrate holder (see PTL 1).

CITATION LIST

Patent Literature

PTL 1: Japanese Unexamined Patent Application Publication No. 2013-155405

SUMMARY OF INVENTION

Technical Problem

The substrate holder described in PTL 1 employs a clamp mechanism exposed outside the substrate holder to fix the second holding member to the first holding member. Specifically, in this substrate holder, a projecting portion of a retaining ring disposed on the second holding member is engaged with a clamper disposed on an outer surface of the first holding member to fix the second holding member to the first holding member.

The substrate holder described in PTL 1 externally includes the clamp mechanism. In view of this, when the substrate holder is removed from plating solution after ending the plating, there is a problem that the plating solution is likely to attach to the clamp mechanism. As a result, when the substrate holder is removed from the plating solution, an amount of the plating solution taken out from a plating bath becomes large, and the large amount of the plating solution is lost. Cleaning the substrate holder to which the large amount of plating solution attached causes poor cleaning efficiency.

The present invention has been made in consideration of the problems. One of the object is to reduce an amount of plating solution attached to a substrate holder.

Solution to Problem

According to one configuration of the present invention, there is provided a substrate holder for holding a substrate. The substrate holder includes a first holding member, a second holding member, a sealing member, a pin, a ring, and a moving mechanism. The second holding member is configured such that the substrate is sandwiched between the first holding member and the second holding member. The sealing member forms a sealed space inside the substrate holder. The pin is fixed to one of the first holding member and the second holding member. The ring is disposed on another of the first holding member and the second holding member. The ring engages with the pin. The moving mechanism circumferentially moves the ring. The pin and the ring are engaged with one another to fix the first holding member and the second holding member to one another. The pin and the ring are disposed inside the sealed space.

According to the present invention, a plating apparatus is provided. This plating apparatus includes the substrate holder, the substrate held to the substrate holder, and a plating bath that houses an anode.

DESCRIPTION OF EMBODIMENTS

Figure 1:
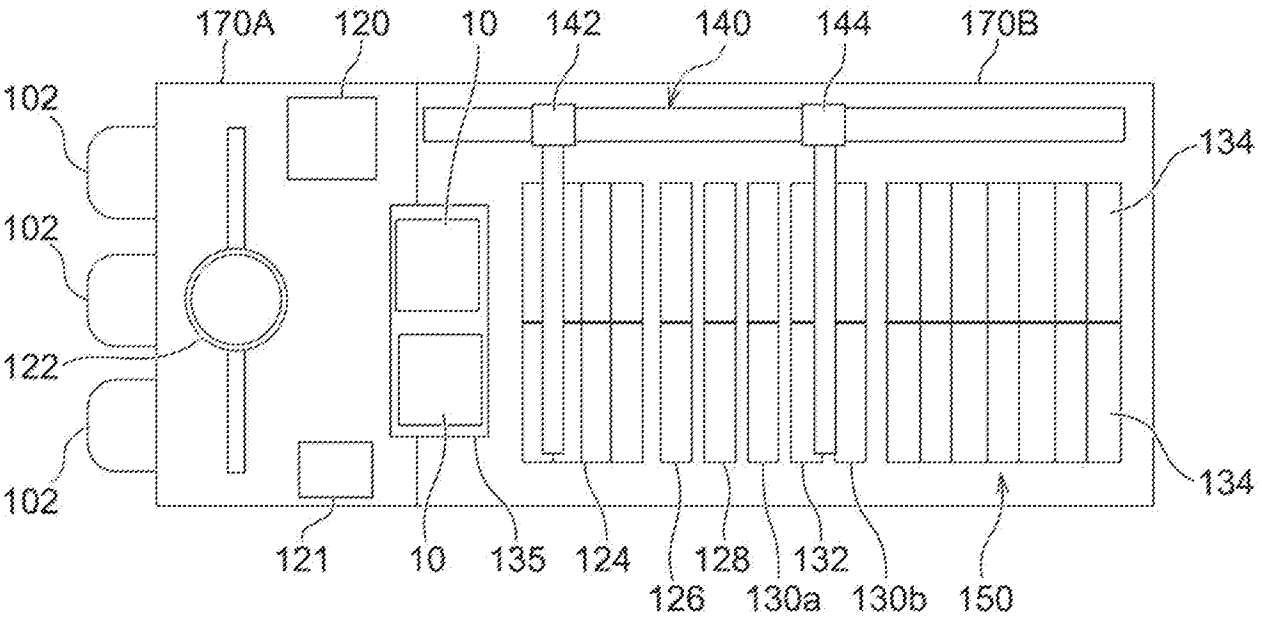
FIG. 1 is an entire layout drawing of a plating apparatus using substrate holders according to an embodiment.

The following describes embodiments of the present invention with reference to the drawings. In the drawings described later, the identical reference numerals are used for the identical or equivalent components, and therefore such components will not be further elaborated here. FIG. 1 is an entire layout drawing of a plating apparatus using substrate holders according to the embodiment. As illustrated in FIG. 1, this plating apparatus is roughly divided into a loading/unloading unit 170A and a processing unit 170B that processes a substrate. The loading/unloading unit 170A loads the substrate to a substrate holder 10 or unloads the substrate from the substrate holder 10.

The loading/unloading unit 170A includes three Front-Opening Unified Pods (FOUPs) 102, an aligner 121, and a spin rinse dryer 120. The FOUPs 102 house a plurality of the substrates such as semiconductor wafers in multiple stages. The aligner 121 aligns positions of, for example, an orientation flat and a notch of the substrate in predetermined directions. The spin rinse dryer 120 rotates the substrate after a plating process at high speed for drying. Nearby the spin rinse dryer 120, a fixing unit 135 on which the substrate holder 10 is placed and the substrate is attached to or removed from the substrate holder 10 is disposed. At the center of these units 102, 121, 120, and 135, a substrate conveying device 122 configured of a robot for conveyance that conveys the substrate between these units is located.

The two substrate holders 10 are mountable on the fixing unit 135. In the fixing unit 135, after the substrate is passed between the one substrate holder 10 and the substrate conveying device 122, the substrate is passed between the other substrate holder 10 and the substrate conveying device 122.

The processing unit 170B in the plating apparatus includes a stocker 124, a pre-wet bath 126, a pre-soak bath 128, a first cleaning bath 130*a*, a blow bath 132, a second cleaning bath 130*b*, and a plating bath 150. The substrate holder 10 is stored and temporarily placed in the stocker 124. The substrate is immersed in pure water in the pre-wet bath 126. In the pre-soak bath 128, an oxide film in a surface of a conducting layer such as a seed layer formed on the surface of the substrate is removed by etching. In the first cleaning bath 130*a*, the substrates after pre-soak are cleaned with cleaning liquid (such as pure water) together with the substrate holders 10. In the blow bath 132, liquid is drained from the substrates after the cleaning. In the second cleaning bath 130*b*, the substrates after plating are cleaned with the cleaning liquid together with the substrate holders 10. The stocker 124, the pre-wet bath 126, the pre-soak bath 128, the first cleaning bath 130*a*, the blow bath 132, the second cleaning bath 130*b*, and the plating bath 150 are located in this order.

The plating bath 150, for example, includes a plurality of plating cells 134 including overflow baths. The plating cells 134 each houses the substrate holder 10 holding the substrate in a vertical direction and immerses the substrate in the plating solution. Applying a voltage between the substrate and an anode in the plating cell 134 performs plating such as copper plating on the surface of the substrate.

The plating apparatus includes a substrate holder conveyance device 140, which is positioned on a side of these respective devices, employing, for example, a linear motor system that conveys the substrate holders 10 together with the substrates between these devices. This substrate holder conveyance device 140 includes a first transporter 142 and a second transporter 144. The first transporter 142 conveys the substrates between the fixing unit 135, the stocker 124, the pre-wet bath 126, the pre-soak bath 128, the first cleaning bath 130*a*, and the blow bath 132. The second transporter 144 conveys the substrates between the first cleaning bath 130*a*, the second cleaning bath 130*b*, the blow bath 132, and the plating bath 150. Specifically, the first transporter 142 and the second transporter 144 convey the substrate holders 10 with in-plane directions of the held substrates facing the vertical direction. In other words, the first transporter 142 and the second transporter 144 convey the substrate holders 10 holding the substrates in the vertical direction.

In another embodiment, the plating apparatus may include any one of only the first transporter 142 and the second transporter 144 and any of the transporters may convey the substrates between the fixing unit 135, the stocker 124, the pre-wet bath 126, the pre-soak bath 128, the first cleaning bath 130*a*, the second cleaning bath 130*b*, the blow bath 132, and the plating bath 150.

Figure 2:
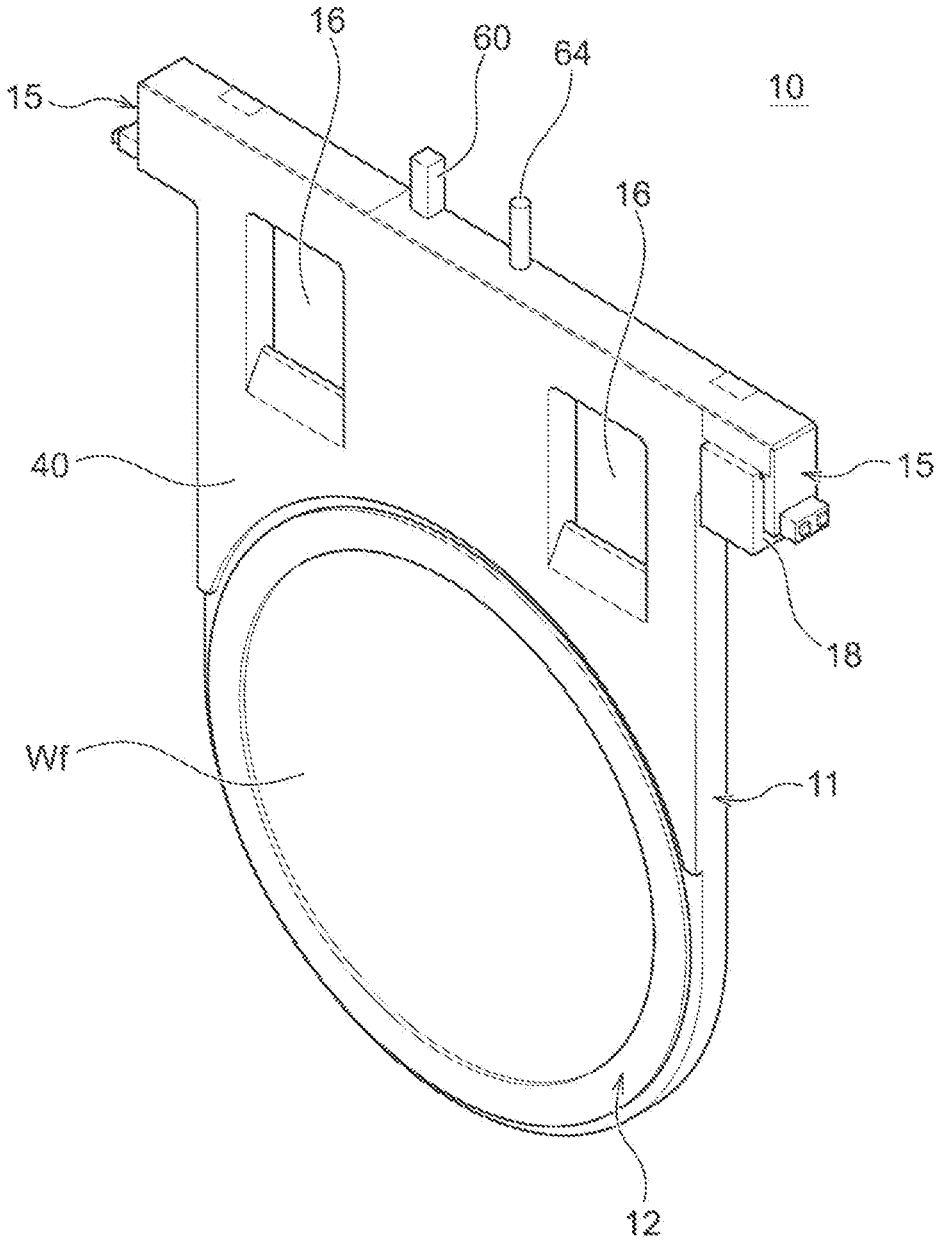
FIG. 2 is a perspective view of the substrate holder.

Next, the following describes the substrate holders 10 illustrated in FIG. 1 in detail. FIG. 2 is a perspective view of the substrate holder 10. As illustrated in FIG. 2, the substrate holder 10 includes a flat plate-shaped first holding member 11 and a second holding member 12. The substrate is sandwiched between the first holding member 11 and the second holding member 12. The first holding member 11 includes a body 40 made of, for example, polytetrafluoroethylene (PTFE). The body 40 serves as a casing constituting an outer surface of the first holding member 11. A substrate Wf is placed on the approximately center of the first holding member 11 of the substrate holder 10.

A pair of hands 15 serving as supporting portions when the substrate holder 10 is suspended to, for example, the plating bath 150 are coupled to ends of the first holding member 11 of the substrate holder 10. In the stocker 124 illustrated in FIG. 1, hooking the hands 15 to a top surface of a peripheral wall of the stocker 124 perpendicularly suspends and supports the substrate holder 10. The first holding member 11 has a pair of openings 16 to grip the substrate holder 10 by the substrate holder conveyance device 140 during conveyance.

In one of the hands 15, an outer contact portion 18 electrically connected to an external power supply (not illustrated) is disposed. This outer contact portion 18 is electrically connected to a base plate 42 and a hooking ring 45 (see FIG. 3) described later. When the substrate holder 10 is suspended to be supported in the plating bath, the outer contact portion 18 contacts a power feeding terminal disposed on the plating bath 150 side. FIG. 2 illustrates a part of a tool 64 and a rod member 60 described later.

Figure 3:
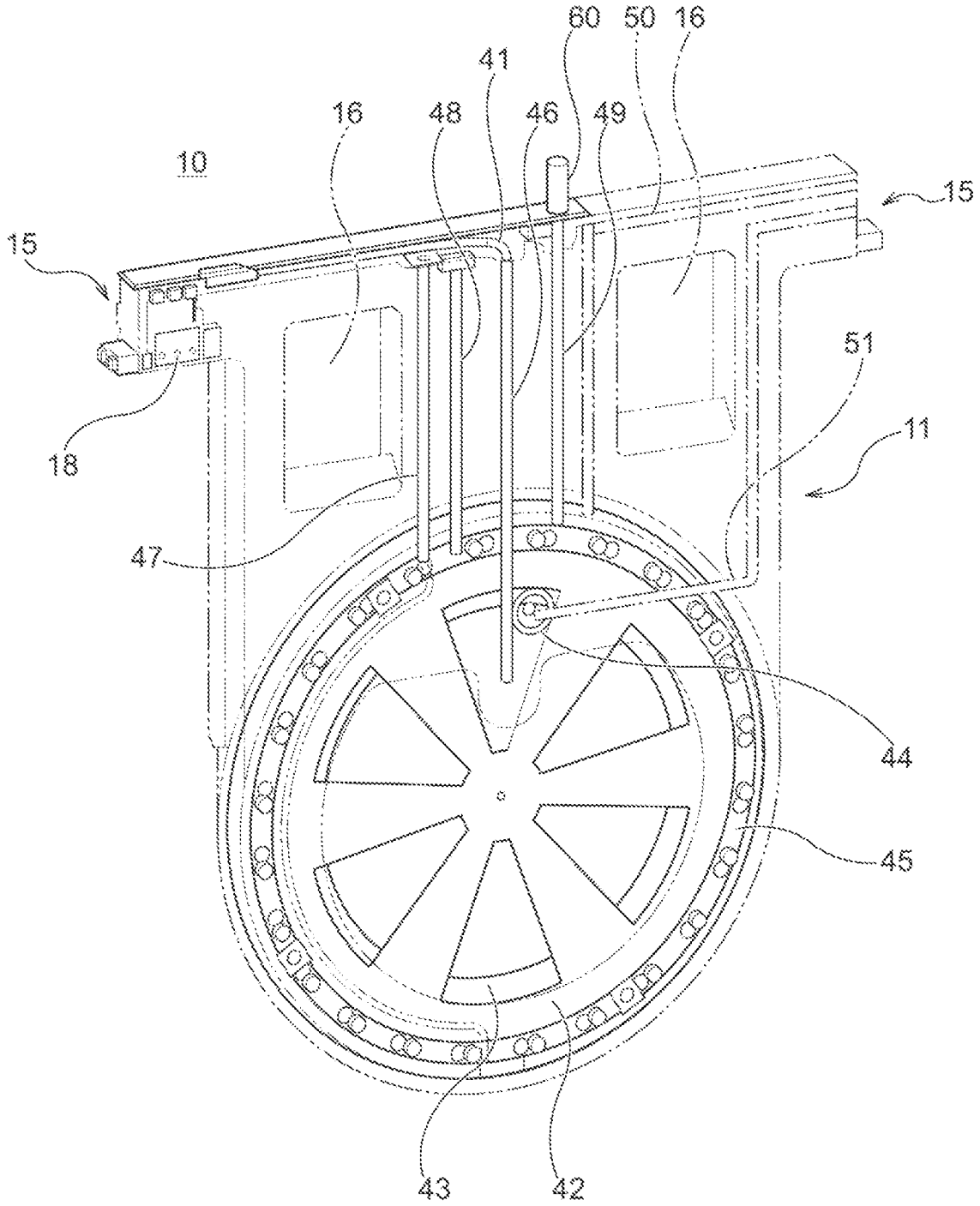
FIG. 3 is a perspective view of a back surface side of the substrate holder.

FIG. 3 is a perspective view of a back surface side of the substrate holder 10. FIG. 3 illustrates the body 40 of the first holding member 11 in a transmission manner. As illustrated in FIG. 3, the first holding member 11 includes a busbar 41, the base plate 42 (corresponding to one example of a fixing plate), a substrate mounting table 43, a suction pad 44, and the hooking ring 45.

The busbar 41 electrically connects the outer contact portion 18 and the base plate 42. The busbar 41 is located in a busbar inner passage 46 formed in the first holding member 11. A seal (not illustrated) seals between the busbar 41 and a wall surface defining the busbar inner passage 46. This allows sealing up the busbar inner passage 46, preventing invasion of liquid into an internal space in the substrate holder 10, and also securing air tightness of the internal space in the substrate holder 10.

The base plate 42 is a circular plate made of a conductive body such as SUS. The base plate 42 has a plurality of openings having an approximately circular sector shape along a circumferential direction and is electrically connected to the busbar 41 at the center. The base plate 42 radially flows a current supplied from the busbar 41 to an outer periphery of the base plate 42 such that the current is supplied to the hooking ring 45. The substrate mounting table 43 is movable with respect to the body 40 and the base plate 42. As described later, a spring 56 (corresponding to one example of a thickness absorbing mechanism) biases the substrate mounting table 43 from the base plate 42 toward the second holding member 12.

The suction pad 44 is disposed on the surface of the substrate mounting table 43 so as to suction the back surface of the substrate Wf located in the substrate mounting table 43. The hooking ring 45 is disposed between the body 40 and the base plate 42, and as described later, engagement with hooking pins 26 fixes the second holding member 12 to the first holding member 11. The hooking ring 45 is made of a conductive body such as SUS and flows a current supplied from the base plate 42 to the hooking pins 26. Although the illustrated suction pad 44 has a suction cup shape having an approximately circular shape, the shape is not limited to this, and the suction pad 44 may have an approximately circular ring shape extending circumferentially.

Additionally, the first holding member 11 internally includes a leakage monitoring inner passage 47, a tool inner passage 48, a rod inner passage 49, a leakage check line 50, and a substrate suction vacuum line 51. In the leakage monitoring inner passage 47, a leakage monitoring wiring 70 electrically connected to a leakage monitoring electrode 71 described later is located. On the tool inner passage 48, the tool 64 described later is located as necessary. The leakage check line 50 is a passage communicating between the internal space in the substrate holder 10 and outside the substrate holder 10 via a leakage check hole 67 (see FIG. 8) described later. The substrate suction vacuum line 51 is a passage communicating between the suction pad 44 and the outside via a vacuum hole 66 described later (see FIG. 8). In the specification, the internal space in the substrate holder 10 means a sealed-up space inside the substrate holder 10 formed by a substrate-side sealing member 21 and a holder-side sealing member 22 described later (see FIG. 4) of the second holding member 12.

Figure 4:
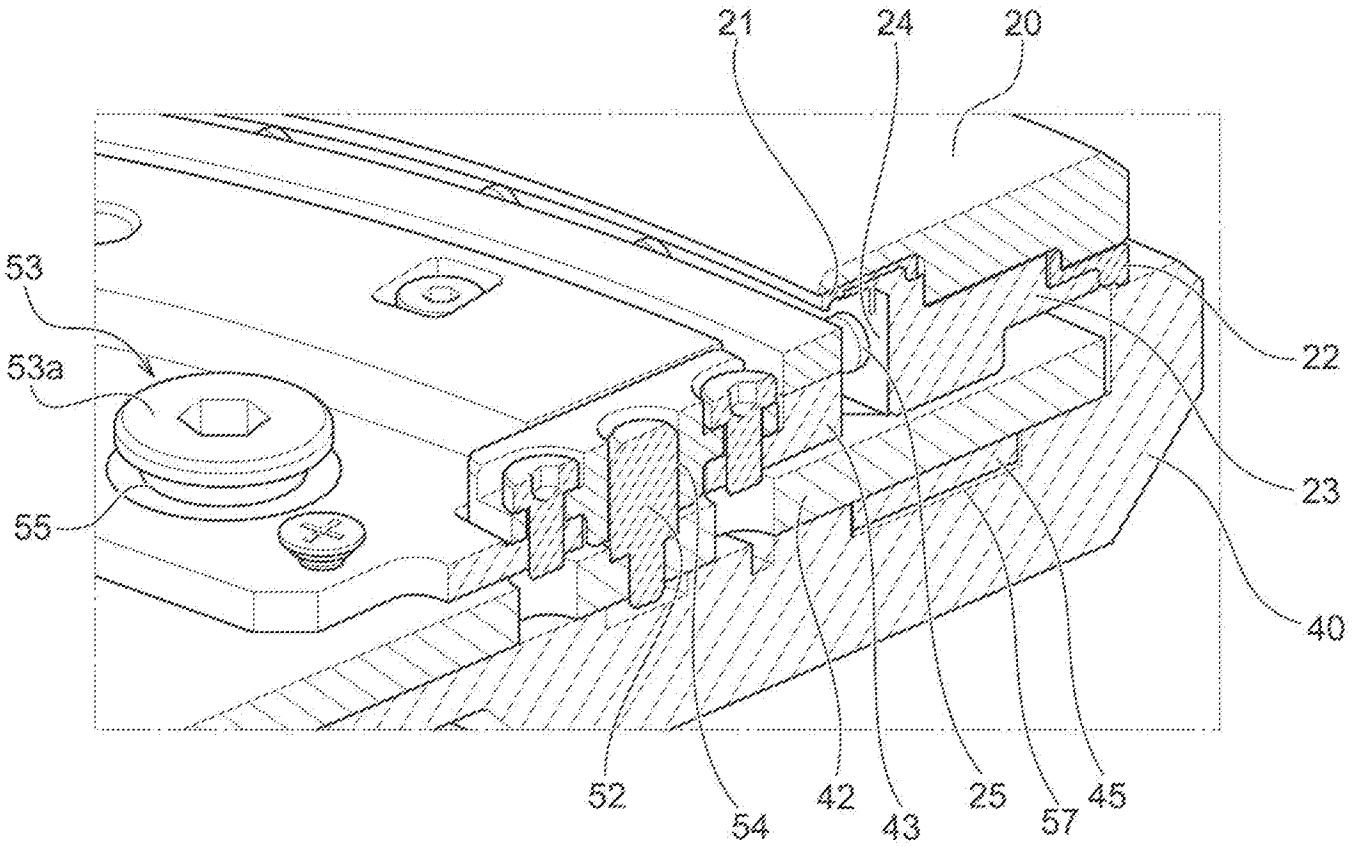
FIG. 4 is a perspective partial cross-sectional view of the substrate holder.

FIG. 4 is a perspective partial cross-sectional view of the substrate holder 10. The substrate Wf is omitted in the illustrated example. As illustrated in FIG. 4, the second holding member 12 includes a seal ring holder 20, the substrate-side sealing member 21 (corresponding to one example of a sealing member), the holder-side sealing member 22 (corresponding to one example of a sealing member), an inner ring 23, and contacts 24. The seal ring holder 20 is an approximately plate-shaped ring. The seal ring holder 20 is a member exposed when the second holding member 12 is mounted to the first holding member 11 and is made of, for example, polyether ether ketone (PEEK) from an aspect of plating solution resistance.

The inner ring 23 is a ring-shaped member mounted to the seal ring holder 20 of the second holding member 12 with a fixing member (not illustrated). A plurality of the contacts 24 are fixed to a radially inner surface of the inner ring 23 with screws 25. The inner ring 23 is made of a conductive body such as SUS for conducting electricity to the contacts 24. The plurality of contacts 24 are configured to contact the substrate Wf along a peripheral edge portion of the substrate Wf when the second holding member 12 is mounted to the first holding member 11.

The substrate-side sealing member 21 is configured to contact the substrate Wf along the peripheral edge portion of the substrate Wf when the second holding member 12 is mounted to the first holding member 11. The holder-side sealing member 22 is configured to contact the body 40 of the first holding member 11 when the second holding member 12 is mounted to the first holding member 11. The substrate-side sealing member 21 and the holder-side sealing member 22 are both formed into approximately ring shapes and are sandwiched by the seal ring holder 20 and the inner ring 23 to be tightly fixed to respective inner peripheral side and outer peripheral side of the seal ring holder 20. By thus contacting the substrate-side sealing member 21 and the holder-side sealing member 22 with the respective substrate Wf and body 40, the sealed-up space (internal space) inside the substrate holder 10 is formed.

As illustrated in the drawing, the first holding member 11 includes a guide shaft 52 and a stopper 53. The substrate mounting table 43 has a through-hole 54 through which the guide shaft 52 passes and a through-hole 55 through which the stopper 53 passes. The guide shaft 52 and stopper 53 have one end each fixed to the base plate 42 and extend inside the through-hole 54 and the through-hole 55 approximately parallel to a normal direction of the substrate Wf. The stopper 53 includes a flange portion 53*a* on the other end on the side opposite to the one end fixed to the base plate 42. The substrate mounting table 43 is biased from the body 40 and the base plate 42 toward the second holding member 12 by the spring 56 described later. The substrate mounting table 43 is guided to be approximately parallel to the planar surface of the substrate Wf by the guide shaft 52. When the substrate mounting table 43 is biased by the spring 56 described later, the substrate mounting table 43 contacts the flange portion 53*a* of the stopper 53 and is restricted to move.

The body 40 of the first holding member 11 has an annular groove 57 to house the hooking ring 45. The hooking ring 45 is movable in a circumferential direction of the hooking ring 45 along the groove 57.

Figure 5A:
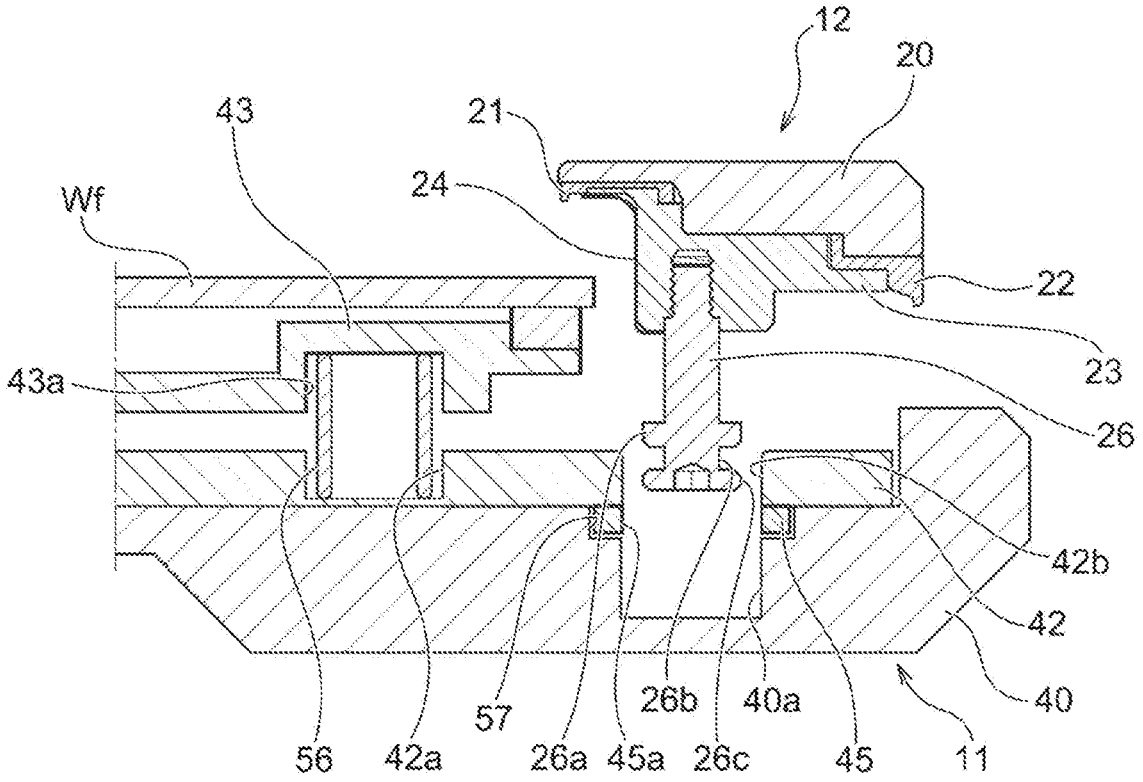
FIG. 5A is a cross-sectional side view of an enlarged part of the substrate holder.
Figure 5B:
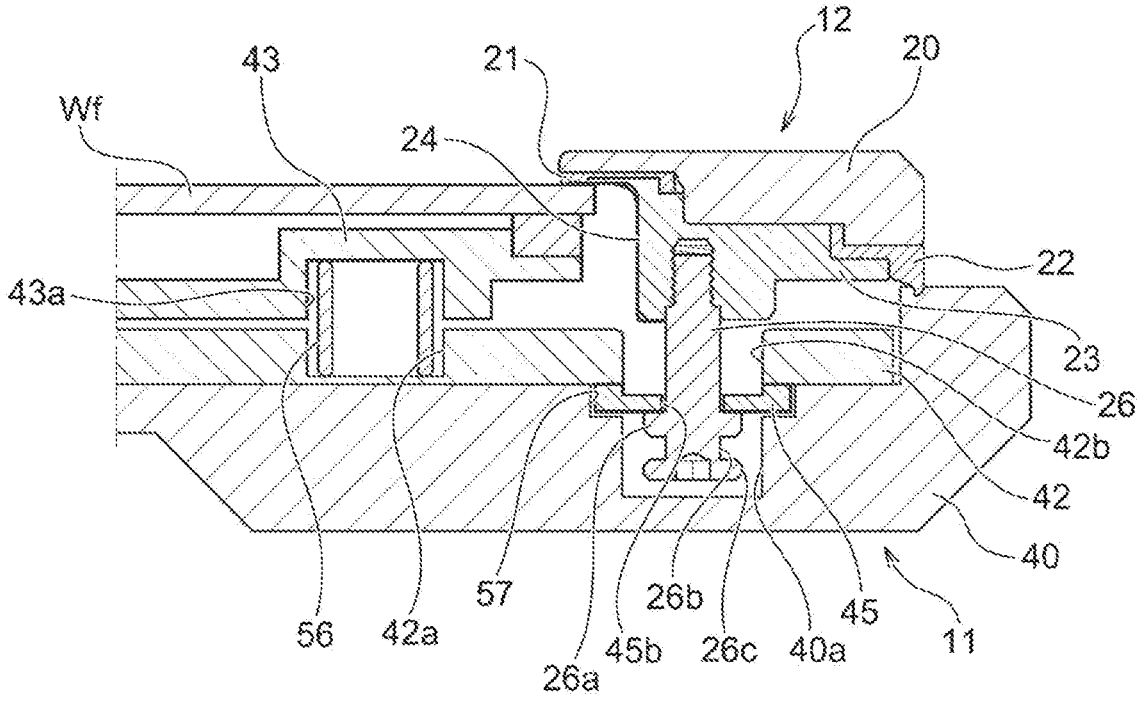
FIG. 5B is a cross-sectional side view of an enlarged part of the substrate holder.
Figure 5C:
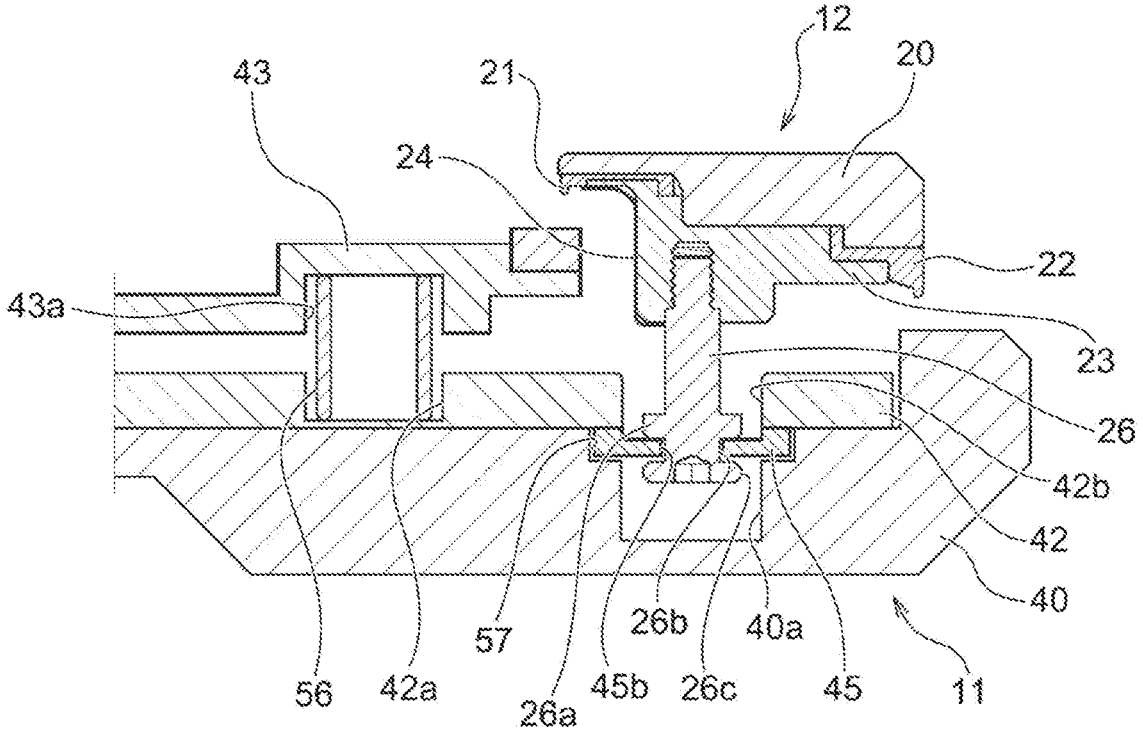
FIG. 5C is a cross-sectional side view of an enlarged part of the substrate holder.

Next, the following describes a process to fix the second holding member 12 to the first holding member 11. FIG. 5A to FIG. 5C are cross-sectional side views of an enlarged part of the substrate holder 10. Specifically, FIG. 5A is a drawing illustrating a state in which the first holding member 11 and the second holding member 12 are not fixed to one another. FIG. 5B is a drawing illustrating a lock state in which the first holding member 11 and the second holding member 12 are fixed to one another and the substrate-side sealing member 21 and the holder-side sealing member 22 contact the substrate Wf and the body 40, respectively. FIG. 5C is a drawing illustrating a semi-lock state in which the first holding member 11 and the second holding member 12 are fixed to one another and the substrate-side sealing member 21 and the holder-side sealing member 22 are separated from the first holding member 11.

As illustrated in FIG. 5A, the spring 56 that biases the substrate mounting table 43 toward the second holding member 12 is disposed between the substrate mounting table 43 and the base plate 42. The spring 56 has one end housed in a depressed portion 42*a* formed in the base plate 42 and the other end housed in a depressed portion 43*a* formed in the substrate mounting table 43. As illustrated in FIG. 5A, when the second holding member 12 is separate from the first holding member 11, the substrate mounting table 43 is biased to a position away from the base plate 42 most by the spring 56.

The second holding member 12 includes the hooking pin 26 engageable with the hooking ring 45. The hooking pin 26 is made of a conductive body such as SUS to flow a current supplied from the hooking ring 45 to the inner ring 23. One end of the hooking pin 26 is fixed to the inner ring 23. The hooking pin 26 has the other end provided with a lock large-diameter portion 26*a*, a small-diameter portion 26*b*, and a semi-lock large-diameter portion 26*c*. The small-diameter portion 26*b* has a diameter smaller than the lock large-diameter portion 26*a*. The semi-lock large-diameter portion 26*c* has a diameter larger than the small-diameter portion 26*b*. In this embodiment, the lock large-diameter portion 26*a* and the semi-lock large-diameter portion 26*c* have approximately identical diameters. As illustrated in the drawing, the small-diameter portion 26*b* is positioned between the lock large-diameter portion 26*a* and the semi-lock large-diameter portion 26*c*. The lock large-diameter portion 26*a* is positioned on the inner ring 23 side with respect to the semi-lock large-diameter portion 26*c*.

The base plate 42 in the first holding member 11 has an opening 42*b* where the hooking pin 26 is passable. The body 40 has a depressed portion 40*a* where the lock large-diameter portion 26*a*, the small-diameter portion 26*b*, and the semi-lock large-diameter portion 26*c* of the hooking pin 26 are passable. As illustrated in FIG. 5A, the hooking ring 45 has a through-hole 45*a* (corresponding to one example of a first part) where the lock large-diameter portion 26*a*, the small-diameter portion 26*b*, and the semi-lock large-diameter portion 26*c* of the hooking pin 26 are passable.

To hold the substrate Wf by the substrate holder 10, the second holding member 12 is pressed against the first holding member 11 with the fixing unit 135 illustrated in FIG. 1. At this time, the lock large-diameter portion 26*a*, the small-diameter portion 26*b*, and the semi-lock large-diameter portion 26*c* of the hooking pin 26 pass through the opening 42*b* and the through-hole 45*a* in the hooking ring 45 and are positioned inside the depressed portion 40*a* of the body 40. As illustrated in FIG. 5B, the substrate-side sealing member 21 is brought into pressure contact with the surface of the substrate Wf, and the holder-side sealing member 22 is brought into pressure contact with the body 40. Pressing the substrate-side sealing member 21 against the surface of the substrate Wf contracts the spring 56 of the substrate mounting table 43 as illustrated in FIG. 5B. Accordingly, even when the thickness of the substrate Wf varies, the substrate-side sealing member 21 can appropriately seal the surface of the substrate Wf.

Figure 6A:
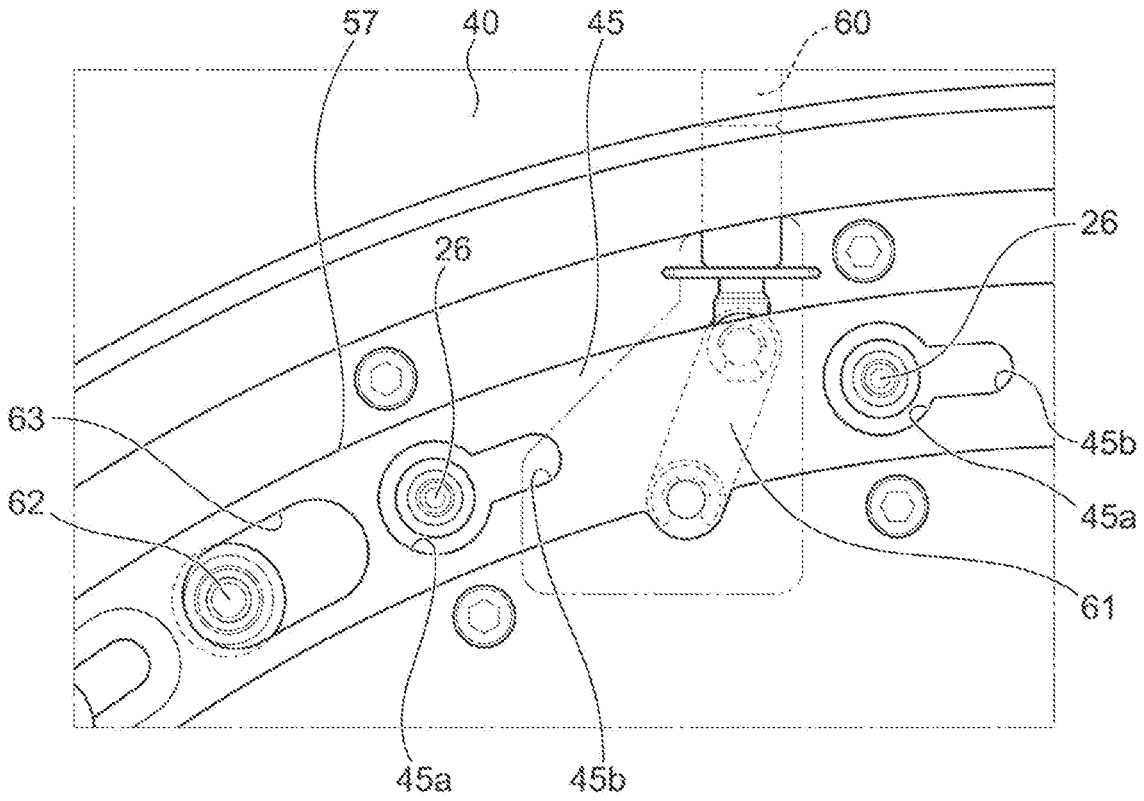
FIG. 6A is a plan view illustrating a position of a hooking ring in a state where the hooking ring does not engage with hooking pins.
Figure 6B:
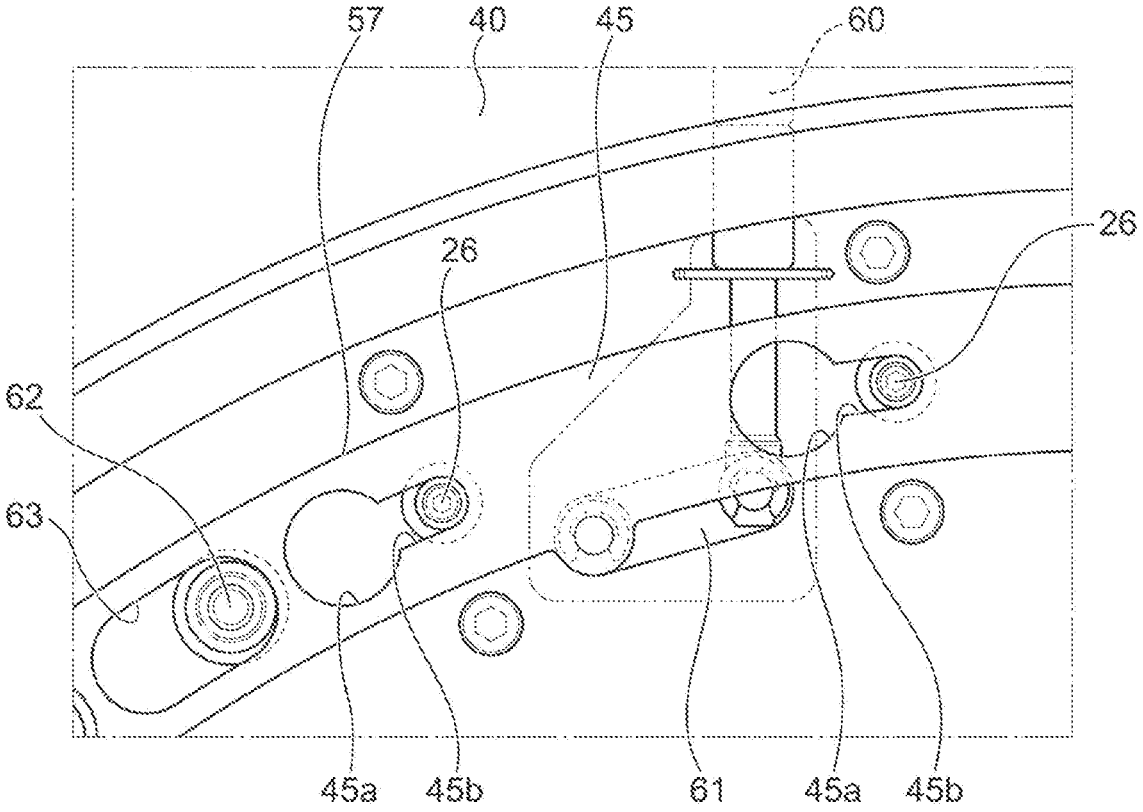
FIG. 6B is a plan view illustrating a position of the hooking ring in a state where the hooking ring engages with the hooking pins.

As illustrated in FIG. 5B, the hooking ring 45 has a through-hole 45*b* (corresponding to one example of a second part) where the lock large-diameter portion 26*a* of the hooking pin 26 cannot pass through. As illustrated in FIG. 6A and FIG. 6B described later, the through-holes 45*a* and the through-holes 45*b* communicate with one another and are continuously formed. The fixing unit 135 illustrated in FIG. 1 causes the hooking ring 45 to circumferentially move in a state where the lock large-diameter portion 26*a* passes through the through-hole 45*a* in the hooking ring 45, that is, in a state where the substrate-side sealing member 21 and the holder-side sealing member 22 are brought into pressure contact with the first holding member 11.

In view of this, as illustrated in FIG. 5B, the lock large-diameter portion 26*a* of the hooking pin 26 engages with the through-hole 45*b* of the hooking ring 45 and the lock large-diameter portion 26*a* does not come off from the through-hole 45*b* of the hooking ring 45. Thus, the substrate-side sealing member 21 and the holder-side sealing member 22 are brought into pressure contact with the substrate Wf and the body 40, respectively, thus ensuring holding the substrate Wf by the substrate holder 10. As illustrated in FIG. 5B, in this embodiment, a state where the substrate-side sealing member 21 contacts the substrate Wf and the holder-side sealing member 22 contacts the first holding member 11 to mutually fix the first holding member 11 and the second holding member 12 is referred to as the lock state.

The following describes a route of a current in the lock state illustrated in FIG. 5B. The current flows from a power source (not illustrated) to the base plate 42 via the busbar 41 (see FIG. 3) coupled to the outer contact portion 18. In the lock state illustrated in FIG. 5B, the hooking ring 45 contacts the hooking pin 26; therefore, the current flows to the contacts 24 in contact with the substrate Wf through the base plate 42, the hooking ring 45, the hooking pin 26, and the inner ring 23.

As illustrated in FIG. 5B, the hooking pin 26 and the hooking ring 45 are positioned in the internal space in the substrate holder 10. Therefore, the hooking pin 26 and the hooking ring 45 do not contact the plating solution even when the substrate holder 10 is immersed in the plating solution. Accordingly, the mechanism to fix the first holding member 11 and the second holding member 12 to one another does not take out the plating solution from the plating bath and an amount of the plating solution attaching to the substrate holder 10 can be reduced.

In this embodiment, the hooking pin 26 is disposed between the substrate-side sealing member 21 and the holder-side sealing member 22. In view of this, compared with the conventional case where an outer peripheral side part of the seal ring holder 20 is clamped to the first holding member 11, the substrate holder 10 of this embodiment can decrease a (bending) moment acting on the seal ring holder 20. Consequently, compared with the conventional one, the substrate holder 10 of this embodiment can further equalize respective force of pressing the substrate-side sealing member 21 against the substrate Wf and force of pressing the holder-side sealing member 22 against the first holding member 11, thereby ensuring further appropriately sealing the internal space in the substrate holder 10.

In the substrate holder 10, after the plating process ends, the substrate Wf is removed in the fixing unit 135 and the substrate Wf is temporarily placed in the stocker 124. At this time, when the holder-side sealing member 22 keeps contacting the body 40 of the first holding member 11, the holder-side sealing member 22 possibly causes deformation. In a case where the substrate Wf is temporarily placed in the stocker 124 while the substrate-side sealing member 21 keeps contacting the substrate mounting table 43, the substrate-side sealing member 21 possibly deforms similarly. Therefore, in the substrate holder 10 of this embodiment, the second holding member 12 can be mounted to the first holding member 11 while the substrate-side sealing member 21 and the holder-side sealing member 22 do not contact the first holding member 11. In this embodiment, as illustrated in FIG. 5C, a state where the first holding member 11 and the second holding member 12 are fixed to one another while the substrate-side sealing member 21 and the holder-side sealing member 22 do not contact the first holding member 11 is referred to as the semi-lock state.

To set the substrate holder 10 in the semi-lock state, the fixing unit 135 illustrated in FIG. 1 causes only the semi-lock large-diameter portion 26*c* of the hooking pin 26 to pass through the through-hole 45*a* in the hooking ring 45 to position the semi-lock large-diameter portion 26*c* in the depressed portion 40*a* in the body 40. A length of the hooking pin 26 is designed such that the substrate-side sealing member 21 and the holder-side sealing member 22 do not contact the first holding member 11 at this time. Subsequently, while only the semi-lock large-diameter portion 26*c* passes through the through-hole 45*a* in the hooking ring 45, the fixing unit 135 illustrated in FIG. 1 causes the hooking ring 45 to circumferentially move. In view of this, as illustrated in FIG. 5C, the hooking ring 45 enters into between the semi-lock large-diameter portion 26*c* and the lock large-diameter portion 26*a*. Consequently, the semi-lock large-diameter portion 26*c* engages with the through-hole 45*b* of the hooking ring 45, and the semi-lock large-diameter portion 26*c* does not come off from the through-hole 45*b* of the hooking ring 45. Thus, the substrate holder 10 can fix the first holding member 11 and the second holding member 12 to one another while the substrate-side sealing member 21 and the holder-side sealing member 22 do not contact the first holding member 11.

Next, the following describes the moving mechanism of the hooking ring 45. FIG. 6A is a plan view illustrating the position of the hooking ring 45 in a state where the hooking ring 45 does not engage with the hooking pins 26. FIG. 6B is a plan view illustrating the position of the hooking ring 45 in a state where the hooking ring 45 engages with the hooking pins 26. As illustrated in the drawing, the through-hole 45*a* has an approximately circular shape and the through-hole 45*b* has an elongate slit shape in the hooking ring 45, and the through-hole 45*a* and the through-hole 45*b* are communicated with one another to form one through-hole. Note that the through-hole 45*a* and the through-hole 45*b* may have any shapes. While the hooking ring 45 includes the through-holes 45*a* and the through-holes 45*b* in this embodiment, cutouts providing similar functions may be disposed instead of these holes.

The substrate holder 10 includes the rod member 60 extending in the rod inner passage 49 illustrated in FIG. 3 and an intermediate member 61 coupled to the hooking ring 45. As illustrated in FIG. 2 and FIG. 3, the rod member 60 has one end positioned outside the substrate holder 10, and as illustrated in FIG. 6A and FIG. 6B, has the other end pivotally joined to the one end of the intermediate member 61. The rod member 60 is axially movable. Specifically, the fixing unit 135 illustrated in FIG. 1 allows the axial movement of the rod member 60 positioned outside the substrate holder 10 through the operation of the rod member 60.

The rod member 60 extends from outside the substrate holder 10 up to the internal space in the substrate holder 10. Accordingly, the rod inner passage 49 illustrated in FIG. 3 communicates between the outside and the internal space of the substrate holder 10. In view of this, the substrate holder 10 preferably includes a packing sealing between the wall surface defining the rod inner passage 49 and the outer peripheral surface of the rod member 60 such that invasion of the liquid into the internal space in the substrate holder 10 through the rod inner passage 49 can be prevented and further, as described later, the presence/absence of the leakage to the internal space in the substrate holder 10 can be confirmed.

The intermediate member 61 is, for example, an elongate plate-shaped member and has one end pivotally joined to the rod member 60 and the other end pivotally joined to the hooking ring 45. While in this embodiment, the rod member 60 and the intermediate member 61 are directly coupled, the configuration is not limited to this. Another member may be interposed between the rod member 60 and the intermediate member 61 and the rod member 60 and the intermediate member 61 may be indirectly coupled. The rod member 60 and the intermediate member 61 constitute a link mechanism together to circumferentially move the hooking ring 45.

The substrate holder 10 includes a stopper pin 62 fixed to the body 40. A slit 63 is disposed along the circumferential direction of the hooking ring 45. As illustrated in the drawing, the stopper pin 62 is inserted into the slit 63.

To engage the hooking pins 26 with the hooking ring 45, first, as illustrated in FIG. 6A, the hooking pins 26 are inserted into the through-holes 45*a* in the hooking ring 45. Specifically, to set the substrate holder 10 in the lock state as illustrated in FIG. 5B, the lock large-diameter portions 26*a* of the hooking pins 26 are passed through the through-holes 45*a*. Further, to set the substrate holder 10 in the semi-lock state as illustrated in FIG. 5C, only the semi-lock large-diameters portions 26*c* of the hooking pins 26 are passed through the through-holes 45*a*.

Subsequently, the fixing unit 135 moves the rod member 60 downward from the state illustrated in FIG. 6A. Thus, the axial movement of the rod member 60 is transformed into the circumferential movement of the hooking ring 45 via the intermediate member 61. Specifically, guided to the groove 57 formed in the body 40, the hooking ring 45 circumferentially moves. In view of this, as illustrated in FIG. 6B, the hooking pins 26 inserted into the through-holes 45*a* are positioned in the through-holes 45*b*. Specifically, the lock large-diameter portions 26*a* or the semi-lock large-diameter portions 26*c* do not come off from the through-holes 45*b* in the hooking ring 45. As illustrated in FIG. 6B, the stopper pin 62 contacts the end of the slit 63 to ensure restricting the additional circumferential movement of the hooking ring 45.

Figure 7:
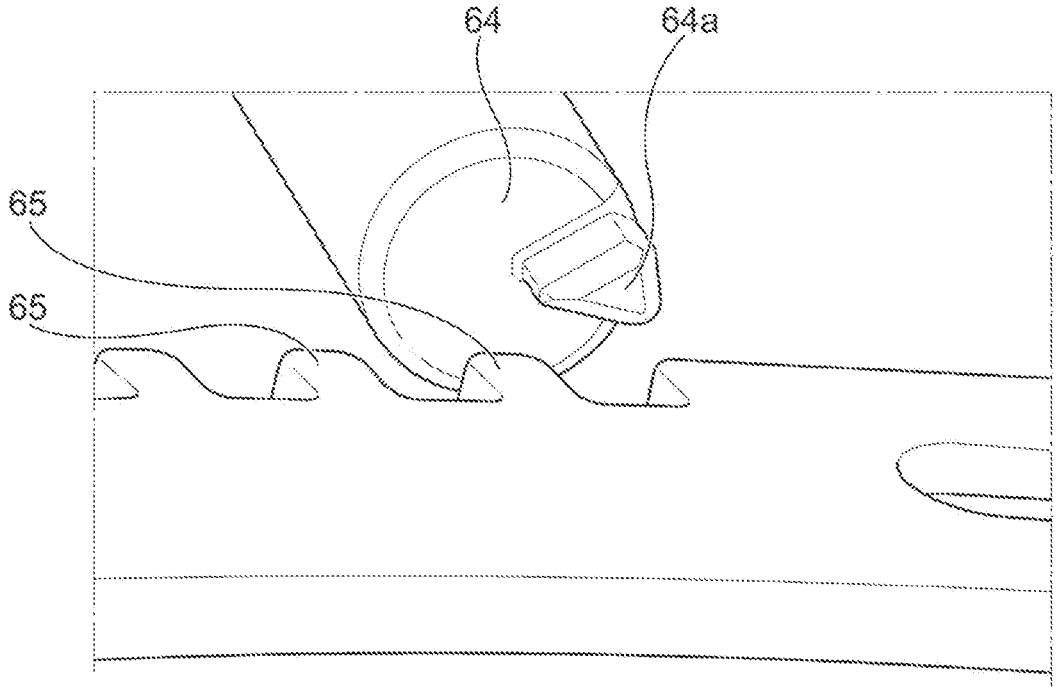
FIG. 7 is a perspective view illustrating a gear mechanism that moves the hooking ring.

In addition to or instead of the link mechanism moving the hooking ring 45 illustrated in FIG. 6A and FIG. 6B, the substrate holder 10 may include a gear mechanism. FIG. 7 is a perspective view illustrating the gear mechanism moving the hooking ring 45. As illustrated in FIG. 7, the hooking ring 45 may include a plurality of teeth 65 located along the circumferential direction of the outer peripheral edge portion. The tool inner passage 48 illustrated in FIG. 3 is Mimed from the outside the substrate holder 10 to the plurality of teeth 65 of the hooking ring 45.

Into the tool inner passage 48 illustrated in FIG. 3, a rod-shaped tool 64 is insertable. As illustrated in FIG. 7, the tool 64 includes a tooth 64*a* engageable with the plurality of teeth 65 of the hooking ring 45 on its distal end. While the tool 64 includes the single tooth 64*a* in this embodiment as illustrated in FIG. 7, the configuration is not limited to this, and the two or more teeth 64*a* may be disposed. The tooth 64*a* of the tool 64 and the plurality of teeth 65 of the hooking ring 45 can transform a rotational motion of the tool 64 into the circumferential motion of the hooking ring 45. Specifically, the circumferential rotation of the tool 64 with the tooth 64*a* of the tool 64 engaged with one of the teeth 65 of the hooking ring 45 circumferentially moves the hooking ring 45 along the groove 57 (see FIG. 6A and a similar drawing).

The tool 64 is insertable into the tool inner passage 48 only when the hooking ring 45 is circumferentially moved. Accordingly, while the tool 64 is not inserted into the tool inner passage 48, a plug (not illustrated) and the like can seal up the tool inner passage 48.

As described above, with the substrate holder 10, the hooking ring 45 can be circumferentially moved from outside the substrate holder 10 with the link mechanism illustrated in FIG. 6A and FIG. 6B or the gear mechanism illustrated in FIG. 7. The gear mechanism illustrated in FIG. 7 may be used in a case where, for example, the link mechanism illustrated in FIG. 6A and FIG. 6B has a failure.

Figure 8:
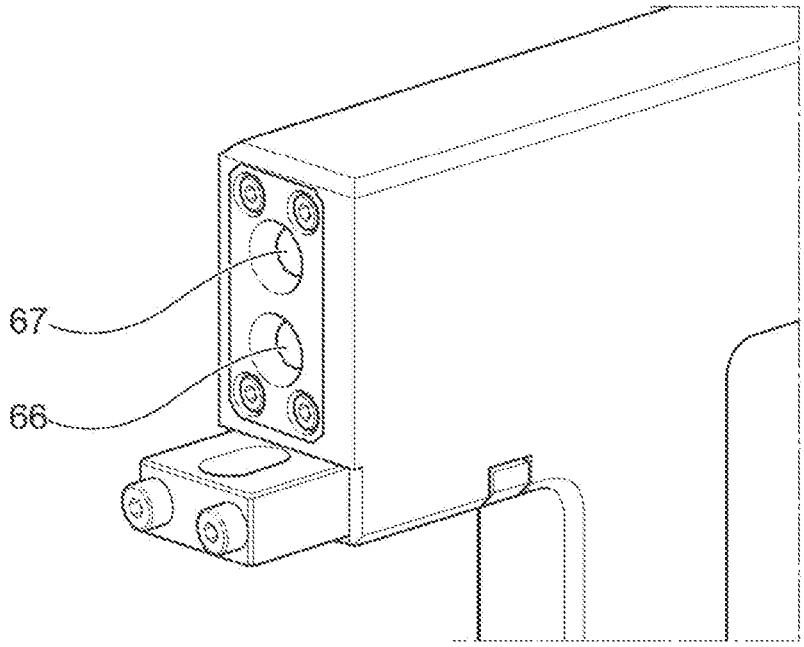
FIG. 8 is an enlarged perspective view of one of hands of the substrate holder.

FIG. 8 is an enlarged perspective view of one of the hands 15 of the substrate holder 10. As illustrated in the drawing, on the side portion of the hand 15, the vacuum hole 66 and the leakage check hole 67 are formed. The vacuum hole 66 is in fluid communication with the suction pad 44 via the substrate suction vacuum line 51 illustrated in FIG. 3. The leakage check hole 67 is in fluid communication with the internal space in the substrate holder 10 via the leakage check line 50 illustrated in FIG. 3.

The following describes a method for using the leakage check hole 67. To plate the substrate Wf, first, the substrate Wf is held to the substrate holder 10 on the fixing unit 135 illustrated in FIG. 1. When the second holding member 12 is mounted to the first holding member 11 on the fixing unit 135 and the lock state illustrated in FIG. 5B is set, the substrate-side sealing member 21 and the holder-side sealing member 22 form the sealed-up space (internal space) inside the substrate holder 10. At this time, a nozzle (not illustrated) coupled to a vacuum source or a pressurization source is inserted into the leakage check hole 67. Subsequently, a vacuum is drawn from or a pressure is applied on the internal space in the substrate holder 10 via the leakage check hole 67.

As long as the substrate-side sealing member 21 and the holder-side sealing member 22 appropriately seal between the first holding member 11 and the second holding member 12, the pressure in the internal space in the substrate holder 10 is maintained. Meanwhile, in a case where between the first holding member 11 and the second holding member 12 is not appropriately sealed due to, for example, damage of the substrate-side sealing member 21 and the holder-side sealing member 22, the pressure in the internal space in the substrate holder 10 possibly changes. In view of this, in this embodiment, when a vacuum is drawn from or a pressure is applied on the internal space in the substrate holder 10, a pressure gauge (not illustrated), which is disposed in the fixing unit 135 and on a side close to the vacuum source or the pressurization source with respect to the nozzle inserted into the leakage check hole 67, can measure the pressure inside the internal space. Instead of the pressure gauge, a flowmeter may measure a minute flow rate. This allows checking whether a leakage occurs in the internal space in the substrate holder 10 before the plating on the substrate Wf.

Figure 9:
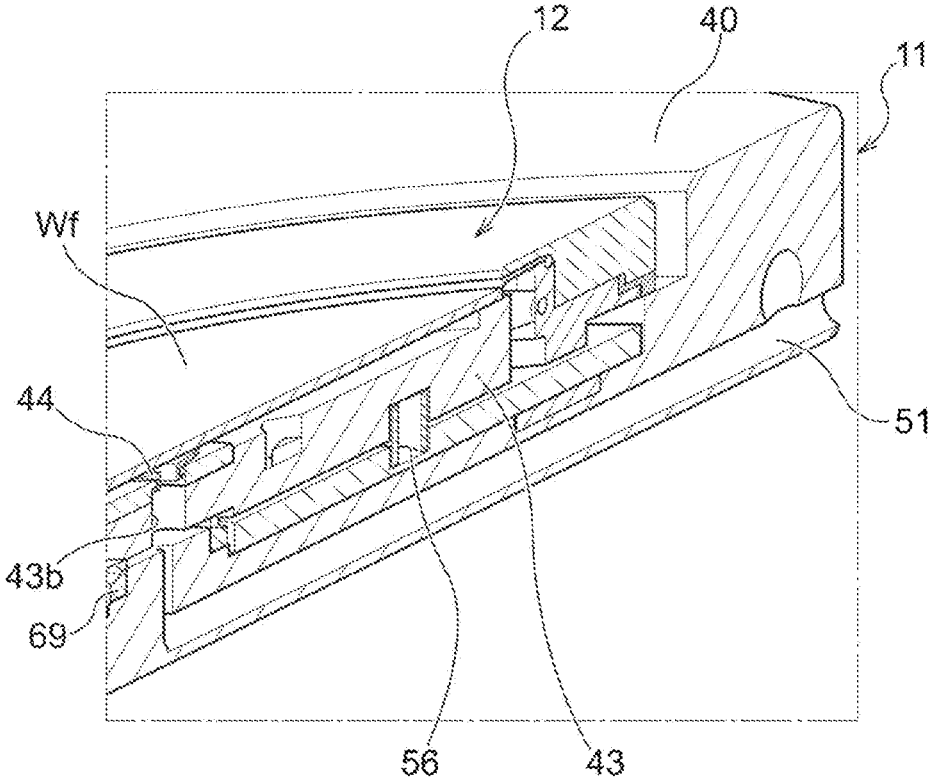
FIG. 9 is a perspective cross-sectional view of the substrate holder.

FIG. 9 is a perspective cross-sectional view of the substrate holder 10. The cross-sectional surface illustrated in FIG. 9 is illustrated including the suction pad 44 illustrated in FIG. 3. As illustrated in the drawing, the substrate suction vacuum line 51 in fluid communication with the vacuum hole 66 illustrated in FIG. 8 is formed inside the body 40 in the substrate holder 10. The substrate suction vacuum line 51 communicates with a space, a gap between the substrate mounting table 43 and the body 40. The substrate mounting table 43 has a hole 43*b* that communicates between the space, which is the gap between the substrate mounting table 43 and the body 40, and the suction pad 44.

As illustrated in the drawing, with the substrate holder 10 of this embodiment, the substrate mounting table 43 is a member different from the body 40 and is biased toward the second holding member 12 with the spring 56. In view of this, a distance between the substrate mounting table 43 and the body 40 differs depending on a thickness of the substrate Wf held. Therefore, the substrate holder 10 of this embodiment includes a packing 69 (corresponding to one example of a second packing) sealing between the body 40 and the substrate mounting table 43. The packing 69, for example, has a seal portion mounted to the body 40 with a diameter expanding to a V shape toward the substrate mounting table 43, thereby ensuring appropriately sealing the gap between the substrate mounting table 43, which moves in the thickness direction of the substrate Wf, and the body 40. Furthermore, as described above, when the internal space in the substrate holder 10 is decompressed or pressurized and a leakage from the seal is checked, the pressure in the internal space does not escape through a vacuum line 51. Accordingly, the vacuum line 51 communicates with the suction pad 44 via the inside of the packing 69.

Figure 10A:
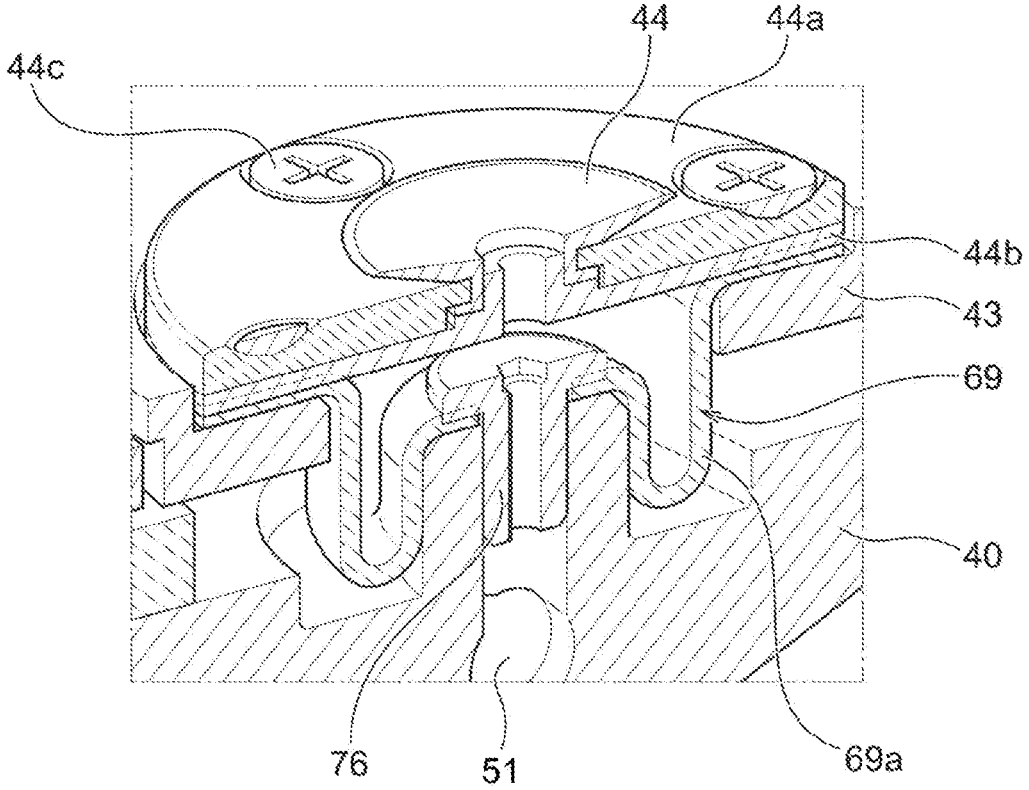
FIG. 10A is a cross-sectional view in a state where a packing is mounted to the substrate holder.
Figure 10B:
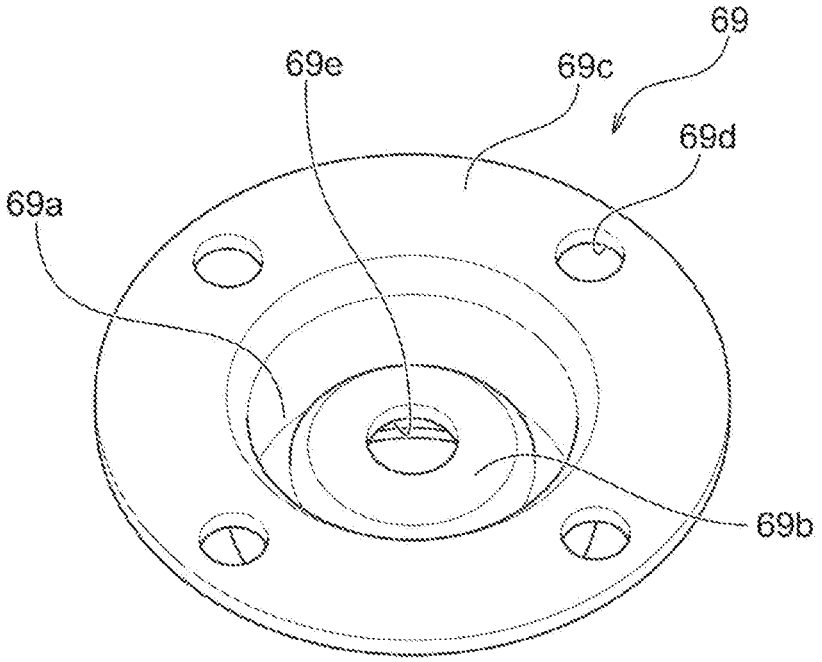
FIG. 10B is a perspective view of the packing.

FIG. 10A and FIG. 10B are drawings illustrating other examples of the packing 69. FIG. 10A is a cross-sectional view in a state where the packing 69 is mounted to the substrate holder 10. FIG. 10B is a perspective view of the packing 69. As illustrated in FIG. 10B, the packing 69 includes a first fixing portion 69*b* having a hole 69*e* at the center, a second fixing portion 69*c* having a plurality of holes 69*d*, and a bellows portion 69*a* that couples the first fixing portion 69*b* and the second fixing portion 69*c* together. The first fixing portion 69*b* is an approximately circular-shaped flat plate. The second fixing portion 69*c* is an approximately annular flat plate having an inner diameter larger than the first fixing portion 69*b*. The bellows portion 69*a* is a serpentine shape part coupling the outer periphery of the first fixing portion 69*b* and the inner periphery of the second fixing portion 69*c*.

As illustrated in FIG. 10A, the suction pad 44 is fixed to the substrate mounting table 43 with an approximately annular-shaped upper fixing plate 44*a* and lower fixing plate 44*b*. Specifically, a part of the suction pad 44 is sandwiched between the upper fixing plate 44*a* and the lower fixing plate 44*b*. The upper fixing plate 44*a* and the lower fixing plate 44*b* are fixed to the substrate mounting table 43 with screws 44*c*. This fixes the suction pad 44 to the substrate mounting table 43.

The second fixing portion 69*c* of the packing 69 is sandwiched between the lower fixing plate 44*b* and the substrate mounting table 43, and inserting the screws 44*c* into the holes 69*d* in the packing 69 fixes the second fixing portion 69*c*. This prevents an air leakage from between the second fixing portion 69*c* of the packing 69 and the lower fixing plate 44*b*. Inserting a fixing screw 76 into the hole 69*e* fixes the first fixing portion 69*b* to the body 40. This prevents an air leakage from between the first fixing portion 69*b* and the body 40. The fixing screw 76 has an axially-penetrating hole. Thus, the substrate suction vacuum line 51 communicates with the suction pad 44 via the hole in the fixing screw 76.

As illustrated in FIG. 10A, the bellows portion 69*a* couples the first fixing portion 69*b* and the second fixing portion 69*c* in the serpentine shape. This partitions a passage communicating between the suction pad 44 and the substrate suction vacuum line 51 and the space between the substrate mounting table 43 and the body 40 by the packing 69. Furthermore, when the substrate mounting table 43 moves in the thickness direction of the substrate Wf, the bellows portion 69*a* can expand and contract between the first fixing portion 69*b* and the second fixing portion 69*c*. Consequently, the packing 69 can appropriately seal the gap between the substrate mounting table 43, which moves in the thickness direction of the substrate Wf, and the body 40. Furthermore, as described above, when the internal space in the substrate holder 10 is decompressed or pressurized and a leakage from the seal is checked, the pressure in the internal space does not escape through the vacuum line 68.

Next, the following describes a method for using the suction pad 44 illustrated in FIG. 9, FIG. 10A, and FIG. 10B. After ending the plating process, the substrate Wf held to the substrate holder 10 is removed on the fixing unit 135 illustrated in FIG. 1. Specifically, the hooking ring 45 is circumferentially moved with the fixing unit 135 to release the engagement with the hooking pins 26 and separate the second holding member 12 from the first holding member 11. Here, since the substrate-side sealing member 21 is brought into pressure contact with the surface of the substrate Wf during the plating process, the substrate-side sealing member 21 is stuck to the substrate Wf in some cases. Therefore, when the substrate Wf stuck to the substrate-side sealing member 21 is removed from the first holding member 11 together with the second holding member 12, the substrate Wf possibly drops due to, for example, unexpected detachment from the substrate-side sealing member 21, resulting in damage.

Therefore, in this embodiment, when the second holding member 12 is removed from the first holding member 11 after ending the plating process, the vacuum source (not illustrated) is coupled to the vacuum hole 66 illustrated in FIG. 8 and suctions a back surface of the substrate Wf with the suction pad 44. Accordingly, the substrate-side sealing member 21 can be peeled off from the surface of the substrate Wf. Additionally, since the substrate holder 10 of this embodiment includes the packing 69, between the substrate mounting table 43 and the body 40 can be appropriately sealed. Consequently, the suction pad 44 can maintain the suction force of the substrate Wf.

Figure 11A:
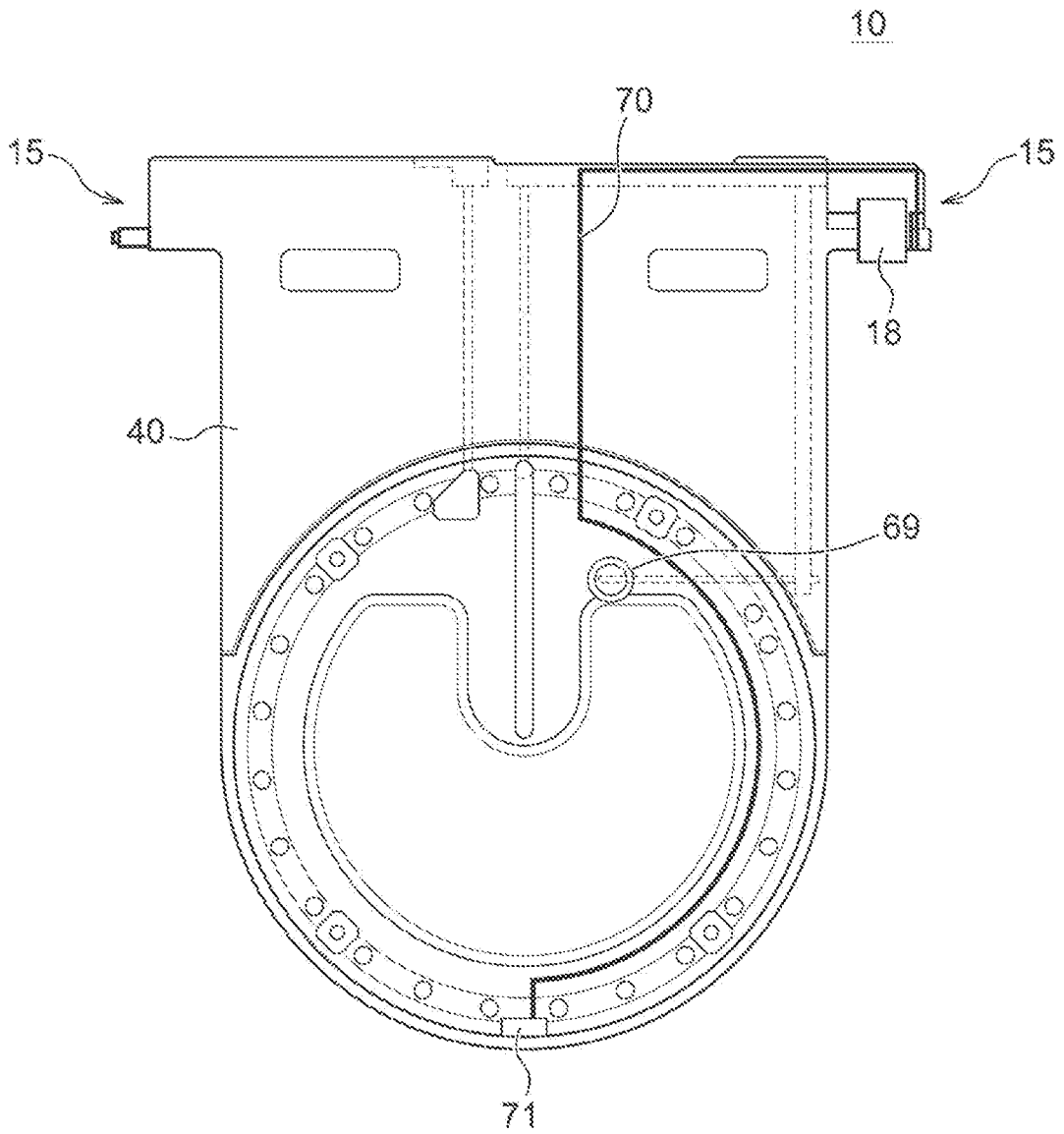
FIG. 11A is a plan view of a body in the substrate holder.
Figure 11B:
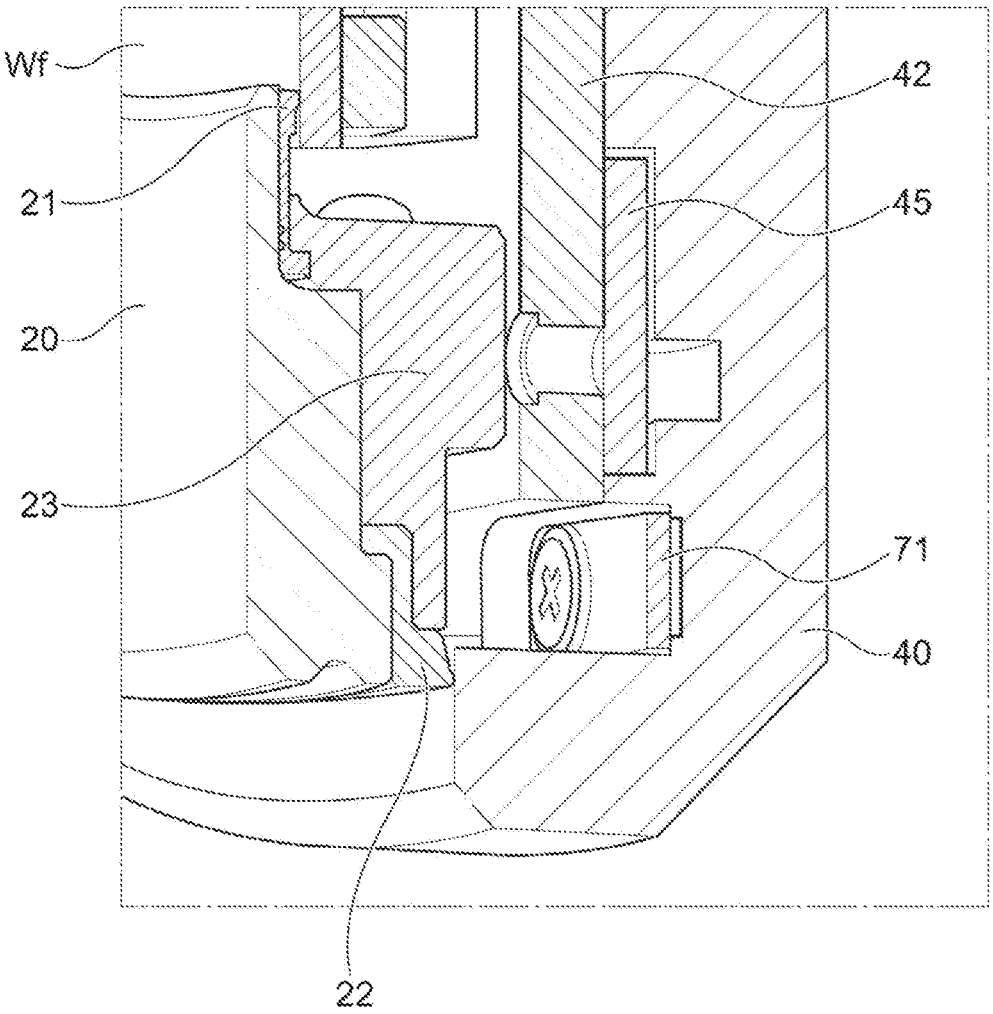
FIG. 11B is a cross-sectional view including a leakage monitoring electrode of the substrate holder.

Next, the following describes a configuration of monitoring the leakage from the substrate-side sealing member 21 and the holder-side sealing member 22 while the substrate holder 10 is immersed in the plating solution. FIG. 11A is a plan view of the body 40 in the substrate holder 10. FIG. 11B is a cross-sectional view including the leakage monitoring electrode 71 of the substrate holder 10. As illustrated in FIG. 11A, the substrate holder 10 includes the leakage monitoring electrode 71. The leakage monitoring electrode 71 is located at a position including the lowest portion of the internal space when the substrate holder 10 is vertically located. The substrate holder 10 further includes an external terminal disposed near the outer contact portion 18 and the leakage monitoring wiring 70 that electrically connects the external terminal and the leakage monitoring electrode 71. The leakage monitoring inner passage 47 in which the leakage monitoring wiring 70 is located has a sealed-up structure such that the pressure in the internal space in the substrate holder 10 does not escape outside the substrate holder 10.

While the substrate Wf held to the substrate holder 10 is plated, a current flows through the substrate Wf via the outer contact portion 18. Here, while the internal space in the substrate holder 10 is sealed, the current does not flow through the leakage monitoring electrode 71. Meanwhile, in a case where, for example, the substrate-side sealing member 21 and the holder-side sealing member 22 are damaged and the plating solution enters into the internal space in the substrate holder 10, the plating solution flows through the internal space vertically downward and the plating solution is accumulated in the lowest portion of the internal space. At this time, the leakage monitoring electrode 71, the inner ring 23 of the second holding member 12, the contacts 24, or the base plate 42 become conductive via the plating solution and the current also flow through the leakage monitoring wiring 70 and the leakage monitoring electrode 71. In this embodiment, a measurement device (not illustrated) that is electrically connected to the external terminal on the substrate holder 10 measures a voltage or a resistance applied to the leakage monitoring wiring 70 and the leakage monitoring electrode 71, thus allowing confirmation that the plating solution has invaded the internal space.

Figure 12:
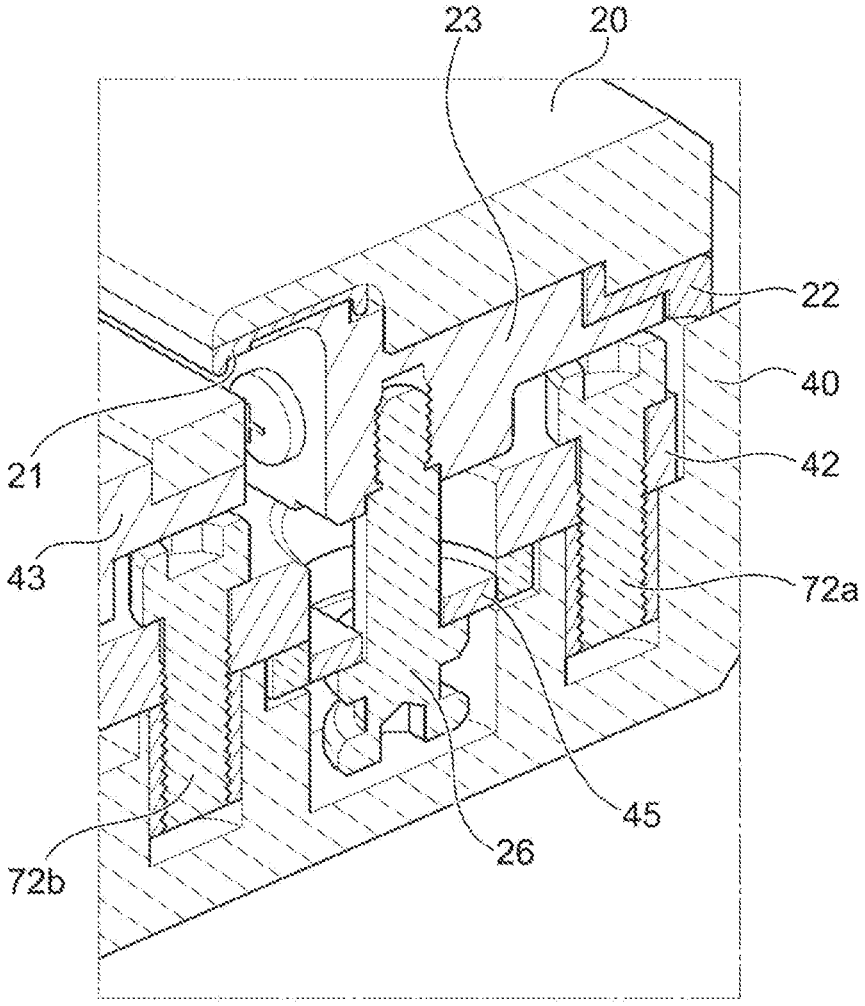
FIG. 12 is an enlarged cross-sectional view near radially outside of a base plate.

FIG. 12 is an enlarged cross-sectional view near radially outside of the base plate 42. As described above, from the aspect of chemical resistance, the body 40 is made of PTFE. Meanwhile, since the base plate 42 needs to have a conductive property, the base plate 42 is made of SUS or a similar substance. The substrate holder 10 according to the embodiment is possibly immersed in a gold plating bath and a copper plating bath according to the substrate Wf held. Since a temperature of the gold plating bath is increased to, for example, around 65° C., a temperature of the substrate holder 10 also possibly increases by the gold plating bath. Here, since PTFE has a coefficient of thermal expansion larger than that of SUS, when PTFE is immersed in comparatively high temperature liquid such as the gold plating bath, a difference between an amount of thermal expansion of the body 40 and an amount of thermal expansion of the base plate 42 becomes comparatively large. Consequently, expansion of the body 40 in an in-plane direction of the substrate Wf possibly adversely affects a sealing performance between the holder-side sealing member 22 and the body 40.

Therefore, in this embodiment, as illustrated in FIG. 12, the base plate 42 and the body 40 are fixed to one another with fixing members 72*a* and 72*b* such as bolts near the outer peripheral portions. Specifically, the body 40 is fixed to the base plate 42 with the fixing member 72*a* radially outside of the hooking ring 45 and is fixed to the base plate 42 with the fixing member 72*b* radially inside of the body 40. On the other hand, although not illustrated, a part of the body 40 radially inside with respect to the fixing member 72*b* is not fixed to the base plate 42. According to this embodiment, even when the temperature of the substrate holder 10 increases and the difference between the amount of thermal expansion of the body 40 and the amount of thermal expansion of the base plate 42 becomes large, the fixing member 72*a* and the fixing member 72*b* can prevent a dismounting between the body 40 and the holder-side sealing member 22.

In this embodiment, a depressed portion may be disposed at the center of the body 40 such that the thickness at the center of the body 40 becomes thinner than the thickness of its outer peripheral portion. In the substrate holder 10 in this embodiment, the base plate 42 and the body 40 are fixed to one another near their outer peripheral portions; therefore, when the body 40 expands, stress occurs in the radial direction of the body 40. Disposing the depressed portion at the center of the body 40 allows early deflecting the center of the body 40. As a result, when the temperature of the substrate holder 10 increases, the stress in the radial direction generated in the body 40 can be dispersed in the thickness direction. The depressed portion disposed in the body 40 is preferably disposed such that the surface of the depressed portion is positioned on the back surface side of the substrate holder 10, in other words, disposed in a direction convexed toward the substrate mounting table 43. This deflects the center of the body 40 toward the substrate mounting table 43. Consequently, the back surface side of the substrate holder 10 can maintain flatness as much as possible.

Figure 13:
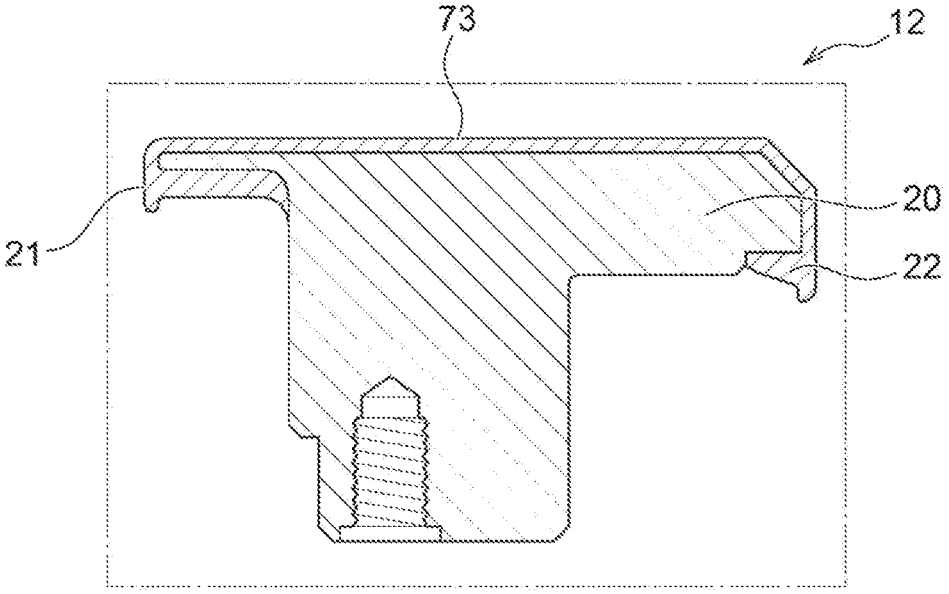
FIG. 13 is a cross-sectional side view of a second holding member according to another embodiment.

Next, the following describes another embodiment of the second holding member 12. FIG. 13 is a cross-sectional side view of the second holding member 12 according to another embodiment. With the already-described second holding member 12, from the aspect of chemical resistance, the seal ring holder 20 possibly in contact with the plating solution is made of, for example, PEEK. However, the seal ring holder 20 made of resin such as PEEK has rigidity lower than that of metal and therefore is disadvantage in ease of deformation.

Therefore, in the second holding member 12 illustrated in FIG. 13, the seal ring holder 20 is made of metal such as SUS to provide the function of the inner ring 23 (see FIG. 4 and a similar drawing). In other words, the seal ring holder 20 and the inner ring 23 are integrally formed. Lining is performed with rubber on the surface of the substrate holder 10 and the substrate-side sealing member 21, the holder-side sealing member 22, and a surface protecting layer 73 are formed. The surface protecting layer 73 coats a part of the seal ring holder 20 exposed to the plating solution to prevent the plating solution from contacting the seal ring holder 20.

With the embodiment illustrated in FIG. 13, since the seal ring holder 20 is made of metal such as SUS, the rigidity can be improved compared with a case of the seal ring holder 20 made of resin such as PEEK. To exchange the substrate-side sealing member 21 or the holder-side sealing member 22, it is only necessary to remove the contacts 24 from the seal ring holder 20 and exchange the seal ring holder 20 itself, making the maintenance easy.

Figure 14:
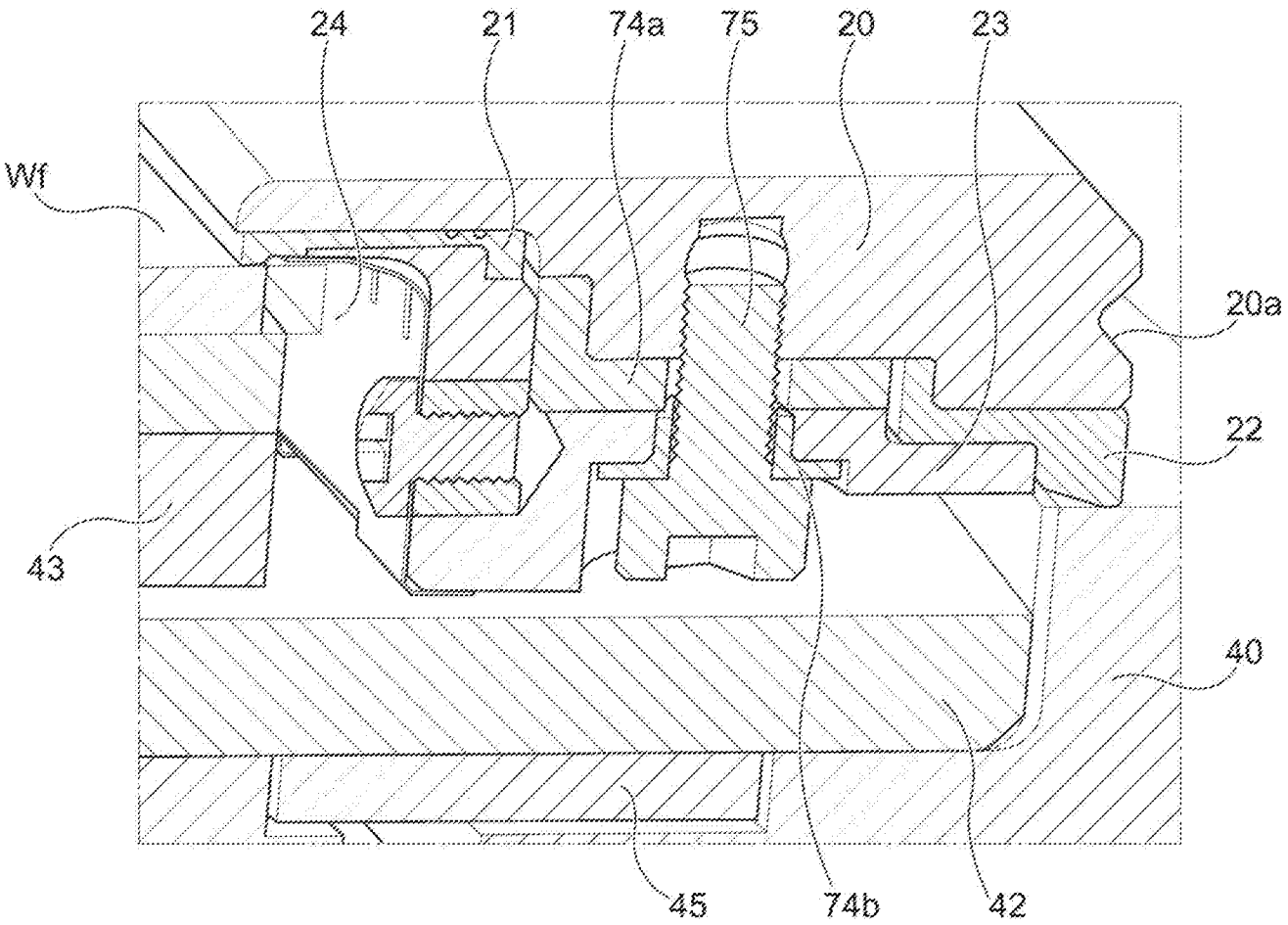
FIG. 14 is a cross-sectional side view of the second holding member according to yet another embodiment.

FIG. 14 is a cross-sectional side view of the second holding member 12 according to yet another embodiment. The second holding member 12 illustrated in FIG. 14 includes the seal ring holder 20 made of titanium. This allows improving the rigidity of the seal ring holder 20 compared with the case where the seal ring holder 20 is made of resin such as PEEK.

However, since the titanium has a conductive property, flowing a current through the seal ring holder 20 plates the surface of the seal ring holder 20. Therefore, the second holding member 12 illustrated in FIG. 14 includes an insulating material 74*a* that insulates between the inner ring 23 and the seal ring holder 20. Furthermore, the second holding member 12 includes an insulating material 74*b* that insulates between the inner ring 23 and a bolt 75 fixing the inner ring 23 to the seal ring holder 20. The insulating material 74*a* and the insulating material 74*b* can be made of, for example, polyvinyl chloride (PVC). This insulates the seal ring holder 20 from the inner ring 23 and can prevent the seal ring holder 20 from being plated.

In the second holding member 12 illustrated in FIG. 14, a depressed portion 20*a* for the fixing unit 135 to hold the second holding member 12 is formed in the outer peripheral surface radially outside of the seal ring holder 20. The depressed portion 20*a* may be a groove extending along the circumferential direction of the seal ring holder 20 or may be a plurality of depressed portions circumferentially disposed equally. To grip the second holding member 12 with the hand (not illustrated), engaging a claw of the hand with the depressed portion 20*a* allows the fixing unit 135 to stably grip the second holding member 12.

Figure 15:
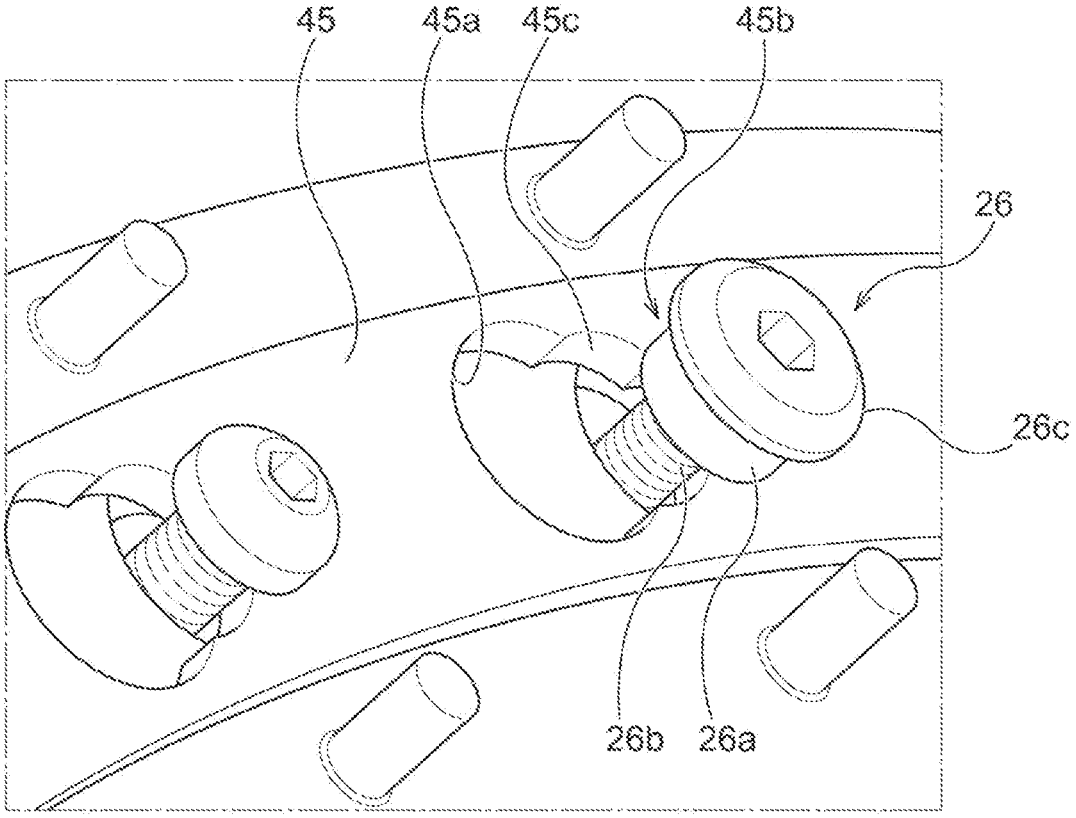
FIG. 15 is a perspective view of the hooking ring and the hooking pins according to another embodiment.

Next, the following describes another embodiment of the hooking ring 45 and the hooking pins 26. FIG. 15 is a perspective view of the hooking ring 45 and the hooking pins 26 according to another embodiment. FIG. 15 illustrates the substrate holder 10 in the lock state. As illustrated in the drawing, the hooking pin 26 includes the lock large-diameter portion 26*a*, the small-diameter portion 26*b*, and the semi-lock large-diameter portion 26*c*. The semi-lock large-diameter portion 26*c* is positioned at the distal end of the hooking pin 26, and the lock large-diameter portion 26*a* is positioned between the small-diameter portion 26*b* and the semi-lock large-diameter portion 26*c*.

The hooking ring 45 includes the through-hole 45*a* (corresponding to one example of the first part), the through-hole 45*b* (corresponding to one example of the second part), and the through-hole 45*c* (corresponding to one example of a third part). The respective through-hole 45*a*, through-hole 45*b*, and through-hole 45*c* have approximately circular shapes and communicate with one another to form one elongated hole. Specifically, the through-hole 45*a* communicates with the through-hole 45*c*, the through-hole 45*c* communicates with the through-hole 45*b*, and the through-hole 45*a* indirectly communicates with the through-hole 45*b* via the through-hole 45*c*. Sizes of diameters of the through-hole 45*a*, the through-hole 45*b*, and the through-hole 45*c* as imaginary circular shapes decrease in the order of the through-hole 45*a*, the through-hole 45*c*, and the through-hole 45*b*.

To set the substrate holder 10 including the hooking ring 45 and the hooking pins 26 illustrated in FIG. 15 in the lock state, first, the through-holes 45*a* are caused to pass through the semi-lock large-diameter portions 26*c* and the lock large-diameter portions 26*a* of the hooking pins 26. Accordingly, the substrate-side sealing member 21 of the second holding member 12 is brought into pressure contact with the substrate Wf and the holder-side sealing member 22 is brought into pressure contact with the body 40. In this state, the link mechanism illustrated in FIG. 6A and FIG. 6B or the gear mechanism illustrated in FIG. 7 circumferentially moves the hooking ring 45 to position the small-diameter portions 26*b* into the through-holes 45*b*. Thus, the lock large-diameter portions 26*a* engage with the through-holes 45*b* and do not come off from the through-holes 45*b*, and the first holding member 11 and the second holding member 12 are fixed to one another.

To set the substrate holder 10 in the semi-lock state, first, only the semi-lock large-diameter portions 26*c* of the hooking pins 26 are caused to pass through the through-holes 45*a*. A length of the hooking pin 26 is designed such that the substrate-side sealing member 21 and the holder-side sealing member 22 do not contact the first holding member 11 at this time. Subsequently, the link mechanism illustrated in FIG. 6A and FIG. 6B or the gear mechanism illustrated in FIG. 7 circumferentially moves the hooking ring 45 to position the lock large-diameter portions 26*a* into the through-holes 45*c*. The lock large-diameter portions 26*a* have outer peripheral parts made of, for example, rubber and are configured to fit to the insides of the through-holes 45*c* and therefore the position of the hooking ring 45 in a longitudinal direction of the hooking pins 26 is not easily displaced. Thus, the semi-lock large-diameter portions 26*c* engage with the through-holes 45*c* and do not come off from the through-holes 45*c*, and the first holding member 11 and the second holding member 12 are fixed to one another while the substrate-side sealing member 21 and the holder-side sealing member 22 are separate from the first holding member 11.

The through-hole 45*a*, the through-hole 45*b*, and the through-hole 45*c* have any shapes. The hooking ring 45 may have cutouts providing a similar function instead of the through-hole 45*a*, the through-hole 45*b*, and the through-hole 45*c*.

Figure 16A:
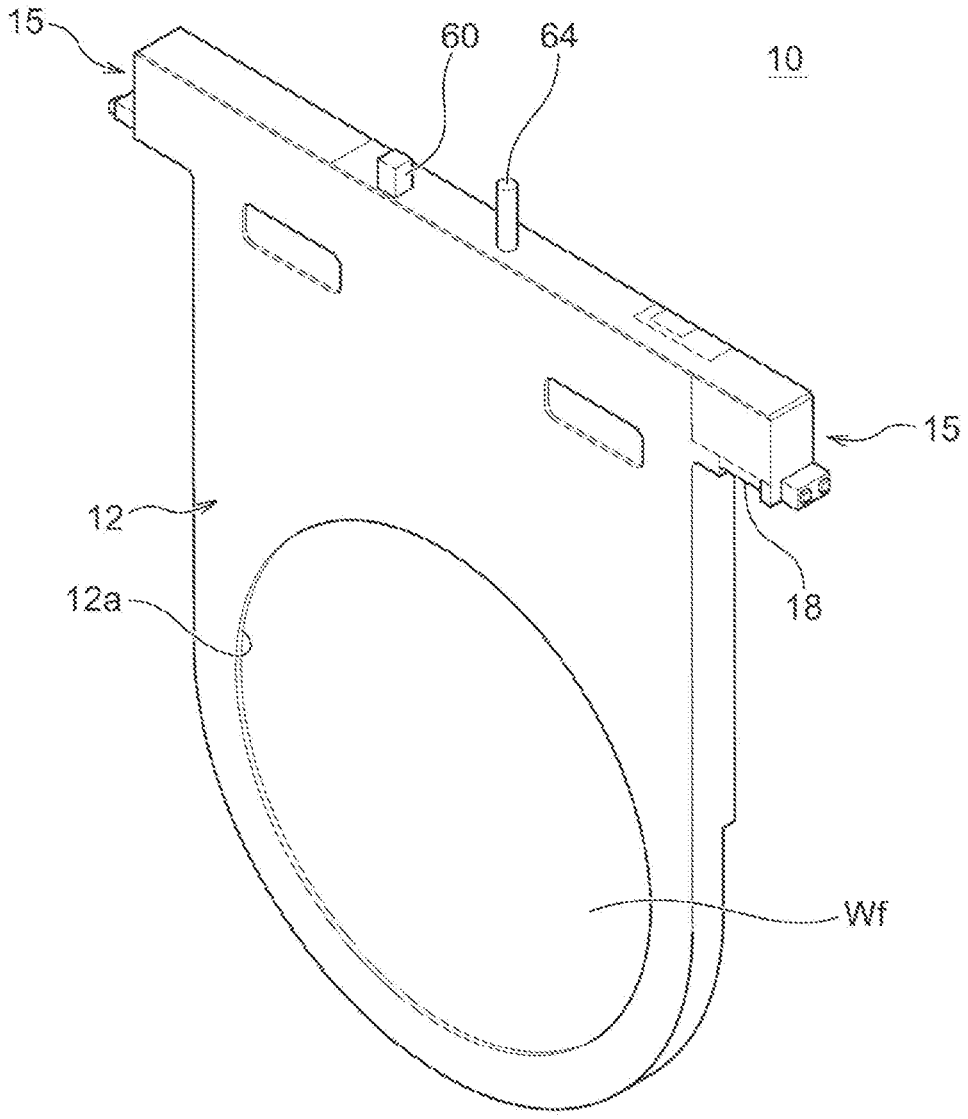
FIG. 16A is a front perspective view of the substrate holder according to another embodiment.
Figure 16B:
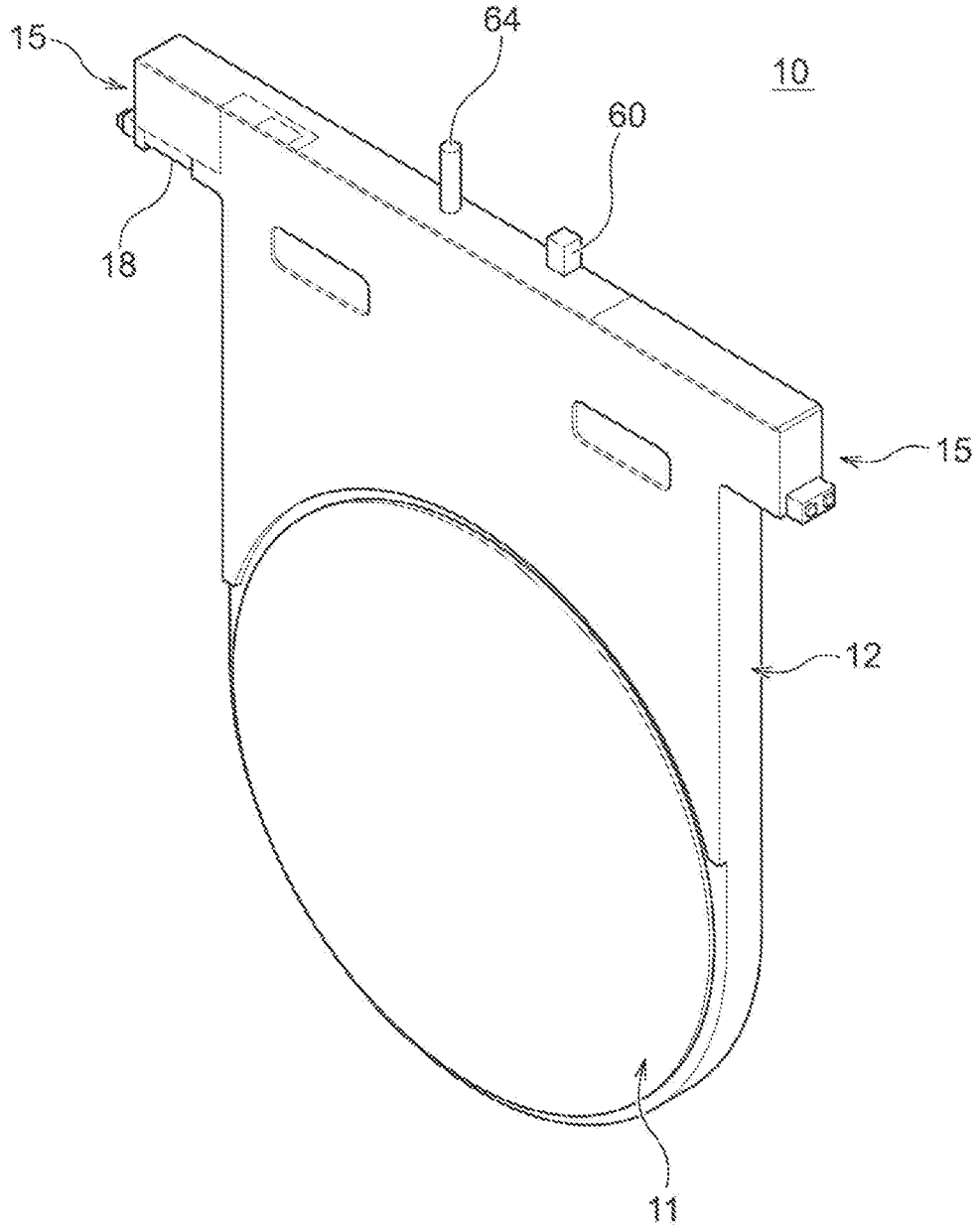
FIG. 16B is a back perspective view of the substrate holder according to another embodiment.

Next, the following describes another embodiment of the substrate holder 10. FIG. 16A is a front perspective view of the substrate holder 10 according to another embodiment. FIG. 16B is a back perspective view of the substrate holder 10 according to another embodiment. As illustrated in FIG. 16A and FIG. 16B, the substrate holder 10 has a circular opening 12*a* in the second holding member 12 from which the substrate Wf is exposed and includes the pair of hands 15 on its ends. Although not illustrated, the second holding member 12 includes the busbar 41 electrically connected to the outer contact portion 18, the substrate-side sealing member 21, the inner ring 23, the contacts 24, the hooking ring 45, and the rod member 60. The busbar 41 is electrically connected to the inner ring 23 disposed in the second holding member 12 directly to supply the contacts 24 with a current.

The first holding member 11 has a circular plate-shaped member as a whole and includes the substrate mounting table 43, the hooking pins 26, and the holder-side sealing member 22 (not illustrated). The holder-side sealing member 22 contacts the second holding member 12 and forms a sealed-up space inside the substrate holder 10 together with the substrate-side sealing member 21 disposed in the second holding member 12. Note that the holder-side sealing member 22 may be disposed in the second holding member 12 so as to contact the first holding member 11. To mutually fix the first holding member 11 and the second holding member, the hooking pins 26 disposed in the first holding member 11 and the hooking ring 45 disposed in the second holding member 12 are engaged.

As described above-since the substrate holder 10 includes the busbar 41, the inner ring 23, and the contacts 24 in the second holding member 12, a current can be supplied from the busbar 41 to the contacts 24 via only the inner ring 23. Accordingly, compared with the substrate holder 10 illustrated from FIG. 2 to FIG. 6B, the number of members required to supply the contacts 24 with the current can be reduced, and therefore unstable supply of the current due to a contact resistance between the members can be reduced.

The embodiments of the present invention have been described above in order to facilitate understanding of the present invention without limiting the present invention. The present invention can be changed or improved without departing from the gist thereof, and of course, the correspondings of the present invention are included in the present invention. It is possible to arbitrarily combine or omit respective constituent elements according to claims and specification in a range in which at least a part of the above-described problems can be solved, or a range in which at least a part of the effects can be exhibited.

The following describes some configurations disclosed by this specification. According to a first configuration, there is provided a substrate holder for holding a substrate. The substrate holder includes a first holding member, a second holding member, a sealing member, a pin, a ring, and a moving mechanism. The second holding member is configured such that the substrate is sandwiched between the first holding member and the second holding member. The sealing member forms a sealed space inside the substrate holder. The pin is fixed to one of the first holding member and the second holding member. The ring is disposed on another of the first holding member and the second holding member. The ring engages with the pin. The moving mechanism circumferentially moves the ring. The pin and the ring are engaged with one another to fix the first holding member and the second holding member to one another. The pin and the ring are disposed inside the sealed space.

According to the first configuration, the pin and the ring are positioned in the internal space in the substrate holder. Therefore, the pin and the ring do not contact the plating solution even when the substrate holder is immersed in the plating solution. Accordingly, the mechanism to fix the first holding member and the second holding member to one another does not take out the plating solution from the plating bath and the amount of the plating solution attaching to the substrate holder can be reduced.

According to a second configuration, in the substrate holder of the first configuration, the moving mechanism includes a link mechanism.

According to a third configuration, in the substrate holder of the second configuration, the link mechanism includes a rod member and an intermediate member. The rod member has one end positioned outside the substrate holder and another end positioned inside the substrate holder to be axially movable. The intermediate member has one end directly or indirectly coupled to the rod member. The intermediate member has another end directly coupled to the ring.

According to the third configuration, the ring positioned in the internal space in the substrate holder can be moved.

According to a fourth configuration, in the substrate holder of the third configuration, the substrate holder includes a rod inner passage into which the rod member is inserted and a first packing that seals between a wall surface defining the rod inner passage and an outer peripheral surface of the rod member.

According to the fourth configuration, invasion of liquid in the internal space in the substrate holder via the rod inner passage into which the rod member is inserted can be prevented.

According to a fifth configuration, in the substrate holder of any one of the first configuration to the fourth configuration, the moving mechanism includes a plurality of teeth. The plurality of teeth are formed in the ring along a circumferential direction. The substrate holder includes an inner passage from outside the substrate holder to the plurality of teeth.

According to the fifth configuration, use of a tool engaging with the plurality of teeth allows the ring positioned in the internal space in the substrate holder to be moved. The substrate holder including the link mechanism can move the ring even when the link mechanism has a failure.

According to a sixth configuration, in the substrate holder of the fifth configuration, the substrate holder includes a tool including a tooth that engages with the plurality of teeth. When the tool is inserted into the inner passage, the tooth on the tool engages with the plurality of teeth.

According to the sixth configuration, the use of the tool allows the ring positioned in the internal space in the substrate holder to be moved. The substrate holder including the link mechanism can move the ring even when the link mechanism has a failure.

According to a seventh configuration, in the substrate holder of any one of the first configuration to sixth configuration, the pin includes a lock large-diameter portion. The ring has a first part and a second part. The lock large-diameter portion of the pin is passable through the first part. The second part is engageable with the lock large-diameter portion of the pin.

According to the seventh configuration, engaging the lock large-diameter portion with the second part of the ring allows engaging the ring with the pin, and this consequently allows the first holding member and the second holding member to be fixed to one another.

According to an eighth configuration, in the substrate holder of the seventh configuration, while the lock large-diameter portion of the pin is caused to pass through the first part and the sealing member is brought into pressure contact with the first holding member, the moving mechanism circumferentially moves the ring to engage the lock large-diameter portion with the second part of the ring.

According to the eighth configuration, engaging the lock large-diameter portion with the second part of the ring allows the first holding member and the second holding member to be fixed to one another with the sealing member brought into pressure contact with the first holding member.

According to a ninth configuration, in the substrate holder of the seventh configuration or the eighth configuration, the pin includes a small-diameter portion and a semi-lock large-diameter portion. The small-diameter portion has a diameter smaller than the lock large-diameter portion. The semi-lock large-diameter portion has a diameter larger than the small-diameter portion. The small-diameter portion is positioned between the lock large-diameter portion and the semi-lock large-diameter portion. While the semi-lock large-diameter portion of the pin is caused to pass through the first part and the sealing member is separated from the first holding member, the moving mechanism circumferentially moves the ring such that the semi-lock large-diameter portion is engaged with the second part of the ring.

According to the ninth configuration, engaging the semi-lock large-diameter portion with the second part of the ring allows the first holding member and the second holding member to be fixed to one another while the sealing member is separated from the first holding member.

According to a tenth configuration, in the substrate holder of the seventh configuration, the pin includes a small-diameter portion and a semi-lock large-diameter portion. The small-diameter portion has a diameter smaller than the lock large-diameter portion. The semi-lock large-diameter portion has a diameter larger than the lock large-diameter portion. The ring includes a third part engageable with the semi-lock large-diameter portion of the pin. The first part and the third part are continuously formed. The second part and the third part are continuously formed.

According to the tenth configuration, engaging the lock large-diameter portion with the second part of the ring or engaging the semi-lock large-diameter portion with the third part of the ring allows the first holding member and the second holding member to be fixed to one another.

According to an eleventh configuration, in the substrate holder of the tenth configuration, while the lock large-diameter portion and the semi-lock large-diameter portion of the pin are caused to pass through the first part and the sealing member is brought into pressure contact with the first holding member, the moving mechanism circumferentially moves the ring to engage the lock large-diameter portion with the second part of the ring.

According to the eleventh configuration, engaging the lock large-diameter portion with the second part of the ring allows fixing the first holding member and the second holding member to be fixed to one another with the sealing member brought into pressure contact with the first holding member.

According to a twelfth configuration, in the substrate holder of the tenth configuration or the eleventh configuration, while the semi-lock large-diameter portion of the pin is caused to pass through the first part and the sealing member is separated from the first holding member, the moving mechanism circumferentially moves the ring such that the semi-lock large-diameter portion is engaged with the third part of the ring.

According to the twelfth configuration, engaging the semi-lock large-diameter portion with the third part of the ring allows the first holding member and the second holding member to be fixed to one another while the sealing member is separated from the first holding member.

According to a thirteenth configuration, in the substrate holder of any one of the first configuration to the twelfth configuration, the sealing member includes a first seal portion and a second seal portion. The first seal portion contacts the substrate. The second seal portion contacts the first holding member. The pin is located between the first seal portion and the second seal portion.

According to the thirteenth configuration, compared with the conventional case where the outer peripheral side part of the seal ring holder is clamped to the second holding member, a force to hold the seal ring holder to the second holding member can act on the radially inner side. Consequently, compared with the conventional one, the force pressing the substrate-side sealing member and the holder-side sealing member against the first holding member can be further equalized and the internal space in the substrate holder can be further appropriately sealed.

According to a fourteenth configuration, in the substrate holder of any one of the first configuration to the thirteenth configuration, the first holding member includes, a fixing plate; a substrate mounting table on which the substrate is mountable, and a thickness absorbing mechanism that biases the substrate mounting table from the fixing plate toward the second holding member to absorb a change in thickness of the substrate.

According to the fourteenth configuration, pressing the substrate-side sealing member against the surface of the substrate contracts the thickness absorbing mechanism of the substrate mounting table. Accordingly, even when the thickness of the substrate varies, the substrate-side sealing member can appropriately seal the surface of the substrate. Additionally, since the substrate mounting table is biased toward the second holding member by the thickness absorbing mechanism in the substrate holder, the force applied from the first holding member to the substrate-side sealing member is larger than the force applied from the first holding member to the holder-side sealing member. When the fourteenth configuration depends on the substrate holder of the thirteenth configuration, the pin is disposed between the substrate-side sealing member and the holder-side sealing member. In view of this, in the substrate holder, compared with the conventional case where the outer peripheral side part of the seal ring holder is clamped to the second holding member, a force to hold the seal ring holder to the second holding member can act on the radially inner side. That is, the force to hold the second holding member can act at the position close to the substrate-side sealing member where the applied force is comparatively large. Consequently, compared with the conventional one, the force pressing the substrate-side sealing member and the holder-side sealing member against the first holding member can be further equalized and the internal space in the substrate holder can be further appropriately sealed in the substrate holder of this embodiment.

According to a fifteenth configuration, in the substrate holder of the fourteenth configuration, the substrate holder includes a suction pad, a second packing, and a vacuum line. The suction pad absorbs a back surface of the substrate placed on the substrate mounting table. The second packing seals between the fixing plate and the substrate mounting table. The vacuum line is formed on the fixing plate. The vacuum line communicates with the suction pad via an inside of the second packing.

According to the fifteenth configuration, between the substrate mounting table and the fixing plate can be appropriately sealed. Consequently, the suction pad can maintain the suction force of the substrate.

According to a sixteenth configuration, a plating apparatus is provided. This plating apparatus includes the substrate holder according to any one of the first configuration to the fifteenth configuration and a plating bath that houses the substrate held to the substrate holder and an anode.

REFERENCE SIGNS LIST

10 . . . substrate holder
11 . . . first holding member
12 . . . second holding member
18 . . . outer contact portion
20 . . . seal ring holder
21 . . . substrate-side sealing member
22 . . . holder-side sealing member
24 . . . contact
26 . . . hooking pin
26*a* . . . lock large-diameter portion
26*b* . . . small-diameter portion
26*c* . . . semi-lock large-diameter portion
44 . . . suction pad
45 . . . hooking ring
45*a* . . . through-hole
45*b* . . . through-hole
45*c* . . . through-hole
49 . . . rod inner passage
51 . . . substrate suction vacuum line
56 . . . spring
60 . . . rod member
61 . . . intermediate member
64 . . . tool
64*a* . . . tooth
65 . . . tooth
69 . . . packing
70 . . . leakage monitoring wiring
71 . . . leakage monitoring electrode
150 . . . plating bath

What is claimed is:

1. A substrate holder for holding a substrate, comprising:
a first holding member;
a second holding member configured such that the substrate is sandwiched between the first holding member and the second holding member;
a sealing member that forms a sealed space inside the substrate holder;
a pin fixed to the second holding member;
a ring disposed on the first holding member, the ring engaging with the pin; and
a moving mechanism that circumferentially moves the ring, wherein
the pin and the ring are engaged with one another to fix the first holding member and the second holding member to one another,
the pin and the ring are disposed inside the sealed space,
the first holding member has an outer contact portion electrically connected to an external power supply,
the ring is electrically connected to the outer contact portion,
the second holding member has contacts configured to supply current to the substrate,
the pin is electrically connected to the contacts,
the contacts are electrically connected to the outer contact portion by the pin,
the current flows to the contacts in contact with the substrate when the pin engages with the ring,
the contacts are not electrically connected to the outer contact portion when the pin is not engaged with the ring,
the moving mechanism includes a plurality of teeth, and the plurality of teeth are formed on an outer peripheral edge portion of the ring along a circumferential direction, and
the substrate holder includes an inner passage from outside the substrate holder to the plurality of teeth.

2. The substrate holder according to claim 1, wherein
the moving mechanism includes a link mechanism.

3. The substrate holder according to claim 2, wherein
the link mechanism includes:
a rod member having one end positioned outside the substrate holder and another end positioned inside the substrate holder to be axially movable; and
an intermediate member having one end directly or indirectly coupled to the rod member, the intermediate member having another end directly coupled to the ring.

4. The substrate holder according to claim 3, comprising:
a rod inner passage into which the rod member is inserted; and
a first packing that seals between a wall surface defining the rod inner passage and an outer peripheral surface of the rod member.

5. The substrate holder according to claim 1, comprising
a tool including a tooth that engages with the plurality of teeth, wherein
when the tool is inserted into the inner passage, the tooth on the tool engages with the plurality of teeth.

6. The substrate holder according to claim 1, wherein
the pin includes a first diameter portion, and
the ring has a first part and a second part, the first diameter portion of the pin is passable through the first part, and the second part is engageable with the first diameter portion of the pin.

7. The substrate holder according to claim 6, wherein
while the first diameter portion of the pin is caused to pass through the first part and the sealing member is brought into pressure contact with the first holding member, the moving mechanism circumferentially moves the ring to engage the first diameter portion with the second part of the ring.

8. The substrate holder according to claim 6, wherein
the pin includes a second diameter portion and a third diameter portion, the second diameter portion has a diameter smaller than the first diameter portion, and the third diameter portion has a diameter larger than the second diameter portion,
the second diameter portion is positioned between the first diameter portion and the third diameter portion, and while the third diameter portion of the pin is caused to pass through the first part and the sealing member is separated from the first holding member, the moving mechanism circumferentially moves the ring such that the third diameter portion is engaged with the second part of the ring.

9. The substrate holder according to claim 6, wherein the pin includes a second diameter portion and a third diameter portion, the second diameter portion has a diameter smaller than the first diameter portion, and the third diameter portion has a diameter larger than the first diameter portion, the ring includes a third part engageable with the third diameter portion of the pin, the first part and the third part are formed adjacent to each other, and the second part and the third part are formed adjacent to each other.

10. The substrate holder according to claim 9, wherein while the first diameter portion and the third diameter portion of the pin are caused to pass through the first part and the sealing member is brought into pressure contact with the first holding member, the moving mechanism circumferentially moves the ring to engage the first diameter portion with the second part of the ring.

11. The substrate holder according to claim 9, wherein while the third diameter portion of the pin is caused to pass through the first part and the sealing member is separated from the first holding member, the moving mechanism circumferentially moves the ring such that the third diameter portion is engaged with the third part of the ring.

12. The substrate holder according to claim 1, wherein the sealing member includes a first seal portion and a second seal portion, the first seal portion contacts the substrate, and the second seal portion contacts the first holding member, and the pin is located between the first seal portion and the second seal portion.

13. The substrate holder according to claim 1, wherein the first holding member includes:

a fixing plate;

a substrate mounting table on which the substrate is mountable; and a thickness absorbing mechanism that biases the substrate mounting table from the fixing plate toward the second holding member to absorb a change in thickness of the substrate.

14. The substrate holder according to claim 13, comprising:

a suction pad that absorbs a back surface of the substrate placed on the substrate mounting table;

a second packing that seals between the fixing plate and the substrate mounting table; and a vacuum line formed on the fixing plate, the vacuum line communicating with the suction pad via an inside of the second packing.

15. The substrate holder according to claim 1, wherein the first holding member includes a base plate electrically connected to the ring.

16. The substrate holder according to claim 15, wherein the first holding member includes a busbar which electrically connects the outer contact portion and the base plate.

17. The substrate holder according to claim 1, wherein the pin directly contacts the contacts.

18. A plating apparatus comprising:

the substrate holder according to claim 1; and a plating bath that houses the substrate held to the substrate holder and an anode.

* * * * *